US009611604B2

(12) United States Patent
Vigneault

(10) Patent No.: US 9,611,604 B2
(45) Date of Patent: Apr. 4, 2017

(54) SCRAPER BLADE DEVICE FOR CLEANING A SURFACE AND METHOD

(71) Applicant: Jimmy Vigneault, Plessiville (CA)

(72) Inventor: Jimmy Vigneault, Plessiville (CA)

( * ) Notice: Subject to any disclaimer, the term of this patent is extended or adjusted under 35 U.S.C. 154(b) by 0 days.

(21) Appl. No.: 14/918,290

(22) Filed: Oct. 20, 2015

(65) Prior Publication Data

US 2016/0040379 A1 Feb. 11, 2016

Related U.S. Application Data

(62) Division of application No. 13/639,311, filed as application No. PCT/CA2011/050187 on Apr. 6, 2011, now abandoned.

(30) Foreign Application Priority Data

Apr. 6, 2010 (CA) ..... 2698744

(51) Int. Cl.
*E01H 5/04* (2006.01)
*E01H 5/06* (2006.01)

(52) U.S. Cl.
CPC ..... *E01H 5/065* (2013.01); *E01H 5/061* (2013.01); *E01H 5/062* (2013.01); *E01H 5/063* (2013.01)

(58) Field of Classification Search
CPC ..... E01H 5/062; E01H 5/061; E01H 5/066; E01H 5/065; E01H 5/063; E01H 1/105
USPC ..... 37/232, 233, 266, 270; 172/264
See application file for complete search history.

(56) References Cited

U.S. PATENT DOCUMENTS

| | | | |
|---|---|---|---|
| 520,479 | A | 5/1894 | Bunnell |
| 1,383,409 | A | 7/1921 | Liddell |
| 2,055,291 | A | 9/1936 | Henry |
| 2,116,351 | A | 5/1938 | Jones |
| 2,337,434 | A | 12/1943 | Washbond |
| 2,962,821 | A | 12/1960 | Peitl |
| 3,199,234 | A | 8/1965 | Reissinger |

(Continued)

FOREIGN PATENT DOCUMENTS

| | | | |
|---|---|---|---|
| CH | 313333 | A | 4/1956 |
| CH | 382207 | A | 9/1964 |

(Continued)

OTHER PUBLICATIONS

Machine translation of FR1050311.

(Continued)

*Primary Examiner* — Robert Pezzuto
(74) *Attorney, Agent, or Firm* — IPAXIO S.E.N.C.

(57) ABSTRACT

The scraper blade device is provided for cleaning a surface, for instance a roadway surface, when moving in a forward direction relative to the surface. The scraper blade device includes an upper blade portion and a bottom blade portion. The bottom blade portion has a plurality of widthwise-disposed blade segments that are adjoined and juxtaposed to one another. The bottom edge of each blade segment is independently slidingly movable in an up and down movement out of alignment with reference to the bottom edge of the other blade segments and is biased towards a downward working direction. The bottom edge of the blade segments is also pivotally movable with reference to the surface to be cleaned about a pivot axis that is substantially parallel to the lowermost edge of the scraper blade device. The bottom edges is biased towards a forward working position.

19 Claims, 20 Drawing Sheets

(56) References Cited

U.S. PATENT DOCUMENTS

| | | | |
|---|---|---|---|
| 3,400,475 | A | 9/1968 | Peitl |
| 3,465,456 | A | 9/1969 | Meyer |
| 3,772,803 | A | 11/1973 | Cote |
| 4,031,966 | A | 6/1977 | Farrell |
| 4,570,366 | A | 2/1986 | Yost |
| 4,669,205 | A | 6/1987 | Smathers |
| 5,140,763 | A | 8/1992 | Nichols |
| 5,191,729 | A | 3/1993 | Verseef |
| 5,437,113 | A | 8/1995 | Jones |
| 5,697,172 | A | 12/1997 | Verseef |
| 5,720,122 | A | 2/1998 | McLellan |
| 5,743,032 | A | 4/1998 | Vauhkonen |
| 5,819,443 | A | 10/1998 | Winter |
| 5,921,010 | A | 7/1999 | Schulte et al. |
| 6,073,371 | A | 6/2000 | Goos et al. |
| 6,701,646 | B2 | 3/2004 | Schultz et al. |
| 6,751,894 | B2 | 6/2004 | Verseef |
| 6,817,118 | B2 | 11/2004 | Schmeichel |
| 6,823,615 | B2 | 11/2004 | Strait |
| 7,107,709 | B2 | 9/2006 | Hamel |
| 7,171,770 | B2 | 2/2007 | Schultz et al. |
| 7,263,789 | B2 | 9/2007 | Hollinrake et al. |
| 7,467,485 | B2 | 12/2008 | Lachance et al. |
| 7,555,853 | B2 | 7/2009 | Paonessa |
| 7,631,441 | B2 | 12/2009 | Hunt |
| 7,658,022 | B2 | 2/2010 | Strait |
| 7,730,643 | B2 | 6/2010 | Mishra et al. |
| 7,841,109 | B2 | 11/2010 | Stevens et al. |
| 8,776,405 | B2 | 7/2014 | Paonessa |
| 2003/0066738 | A1 | 4/2003 | Veenhof |

FOREIGN PATENT DOCUMENTS

| | | | |
|---|---|---|---|
| DE | 1299675 | B | 7/1969 |
| DE | 3711988 | A1 | 10/1988 |
| EP | 1247906 | A2 | 10/2002 |
| FR | 1050311 | A | 1/1954 |
| FR | 2179703 | A1 | 11/1973 |
| FR | 2269608 | A1 | 11/1975 |
| FR | 2349683 | A1 | 11/1977 |
| FR | 2448599 | A1 | 9/1980 |
| JP | 2005068908 | A | 3/2005 |
| WO | 2010015992 | A2 | 2/2010 |

OTHER PUBLICATIONS

Machine translation of FR2179703.

Machine translation of FR2269608.

Machine translation of FR2349683.

International Preliminary Report on Patentability (IPRP) in PCT/CA2011/050187 completed on Aug. 15, 2012.

The Office Actions dated May 30, 2014, Dec. 10, 2014, Mar. 30, 2015 and Jul. 20, 2015 in parent U.S. Appl. No. 13/639,311.

Machine translation of DE1299675.

SCRAPER BLADE DEVICE FOR CLEANING A SURFACE AND METHOD

CROSS-REFERENCE TO PRIOR APPLICATIONS

The present case is a divisional of U.S. patent application Ser. No. 13/639,311 filed on 4 Oct. 2012, which is a national stage filing under Section 371 of International patent application No. PCT/CA2011/050187, filed on 6 Apr. 2011 and published in English as WO 2011/123956 on 13 Oct. 2011. PCT/CA2011/050187 claims priority to Canadian patent application No. 2,698,744 filed on 6 Apr. 2010. The entire contents of all these prior patent applications are incorporated herein by reference in their entirety.

TECHNICAL FIELD

The technical field relates generally to scraper blade devices and methods for cleaning surfaces by removing undesirable materials from the surfaces.

BACKGROUND

One example of a surface to be cleaned is a roadway surface on which accumulated some snow and/or ice (which are hereafter generically referred to in a non-limitative manner as "frozen water materials"). This is generally done using a rigid blade having a lowermost edge that is in engagement with the roadway surface. The blade is attached to a vehicle, for instance a truck or the like, travelling over the roadway. In this context, the blade is often called a "snowplow". A snowplow blade is often relatively large so as to maximize the width of the surface cleaned by a single pass. Such concept, however, assumes that the roadway surface is perfectly smooth, flat and free of obstructions. In practice, road surfaces are not. For instance, the surface height often varies irregularly from one end of the lowermost edge of the blade to the other and the surface height varies all the time as the blade moves thereon. The lowermost edge is therefore not always fully in engagement with the roadway surface over its entire length, with the result that some frozen water materials tend to remain on the roadway surface at various locations, especially where the surface height is the lowest compared to the immediate surrounding areas. The efficiency of the cleaning is thus reduced.

Road maintenance operators must often use de-icing chemicals to melt the remaining frozen water materials so as to complete the cleaning. The amounts of de-icing chemicals are generally inversely proportional to efficiency of the cleaning. Thus, if the cleaning is inefficient, more de-icing chemicals are required. This has a direct impact on the operating costs and increases the footprint on the environment.

Still, obstructions can be present on the roadway surface and be hit by the lowermost edge of the blade. Some of these obstructions can damage the blade and/or remove a portion of the roadway surface, depending on the nature of the obstructions, when using a rigid blade.

Different approaches have been suggested over the years for mitigating the difficulties experienced with fully-rigid snowplow blades. One approach is presented for instance in Swiss Patent No. 416,708 granted 15 Jul. 1966. This patent uses a series of spring-biased movable plates on the lowermost edge of the blade. It also teaches the use of bolts capable of breaking when subjected to excess stress, such as when the plates hit an obstruction. Similar arrangements are disclosed for instance in U.S. Pat. No. 3,400,475 granted 10 Sep. 1968, in Canadian Patent No. 2,423,830 granted 10 Feb. 2004 and in U.S. Pat. No. 7,467,485 granted 23 Dec. 2008. Another approach is to use a series of plates on the lowermost edge of the blade where the plates are resiliently attached to the rest of the blade. Examples are shown in U.S. Pat. No. 520,479 granted 29 May 1894 and in U.S. Pat. No. 5,743,032 granted 28 Apr. 1998.

Although existing arrangements may have been generally considered adequate for their intended purposes, they have not been entirely satisfactory in all respects. Accordingly, there is still room for many improvements in this area of technology.

SUMMARY

In one aspect, there is provided a scraper blade device for cleaning a surface when moving in a forward direction relative to the surface, the scraper blade device having a front surface and a lowermost edge, the scraper blade device including: an upper blade portion generally defining an upper area of the front surface of the scraper blade device; and a bottom blade portion generally defining a bottom area of the front surface of the scraper blade device, the bottom blade portion including a plurality of widthwise-disposed blade segments that are adjoined and juxtaposed to one another, each blade segment having an upper portion, a bottom portion, a front side face and a rear side face, the bottom portion of each blade segment including a bottom edge and the bottom edges of the blade segments forming together the lowermost edge of the scraper blade device, the bottom edge of each blade segment being independently slidingly movable in an up and down movement out of alignment with reference to the bottom edges of the other blade segments, the bottom edges being biased towards a downward working position by a plurality of first bias mechanisms, the bottom edges being also pivotally movable between a forward working position and a rearward tripped position, with reference to the surface to be cleaned, about a pivot axis that is substantially parallel to the lowermost edge of the scraper blade device, the bottom edges being biased towards the forward working position by at least one second bias mechanism.

In another aspect, there is provided a method of cleaning a surface using a scraper blade device having a front surface and a lowermost edge, the method including: moving the scraper blade device in a forward direction; passing the scraper blade device over irregularities on the surface to be cleaned and continuously varying in height a position of independent blade segments forming the lowermost edge of the scraper blade device, the blade segments being biased towards a downward working position by a plurality of first bias mechanisms; and upon hitting an obstruction with the scraper blade device, temporarily pivoting at least some of the blade segments from a forward working position toward a rearward tripped position to clear the obstruction, the blade segments being biased towards the forward working position by at least one second bias mechanism.

DETAILED DESCRIPTION

Figure 1:
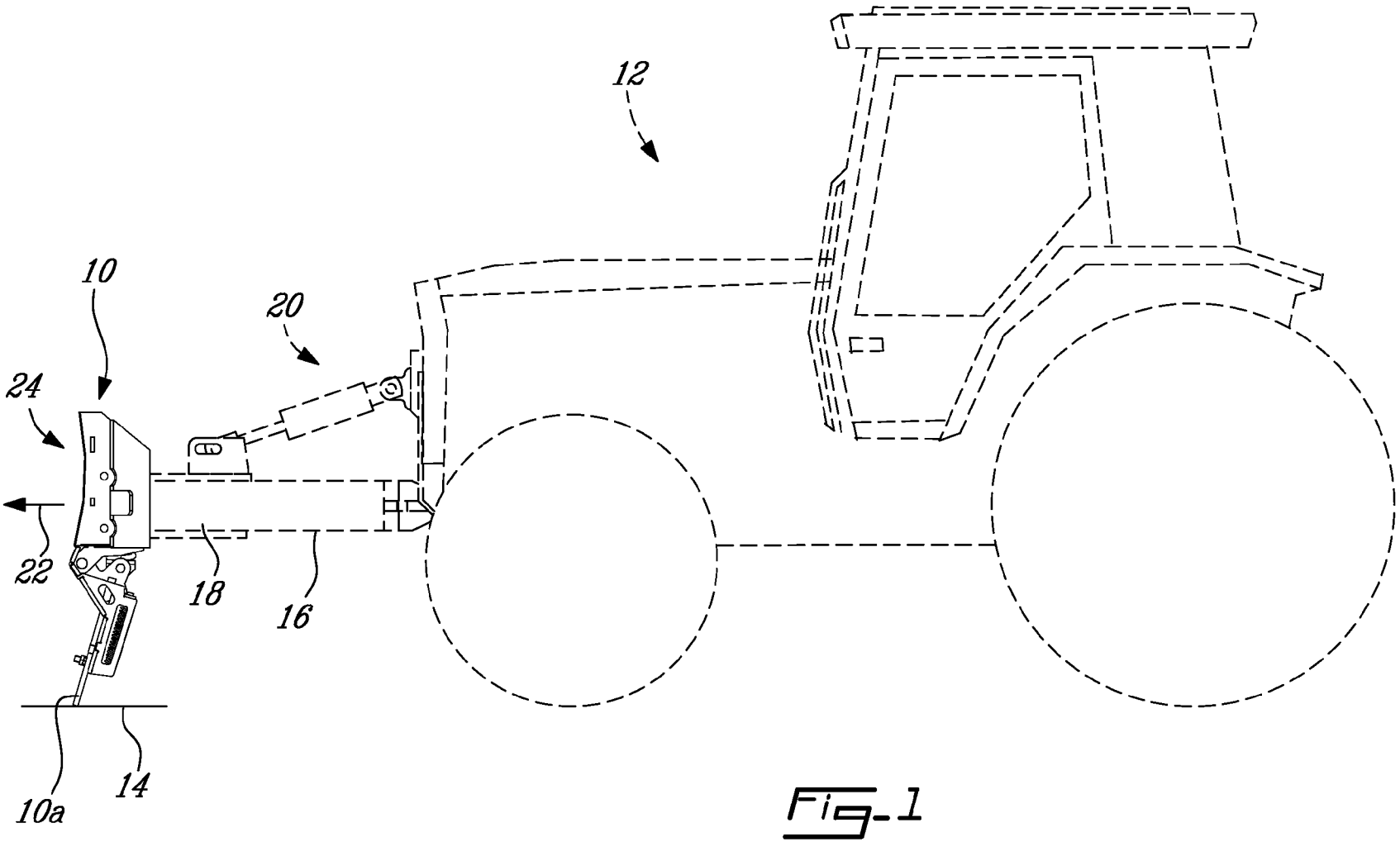
FIG. 1 is a side view of an example of a scraper blade device as suggested herein, the scraper blade device being shown as mounted in front of a generic vehicle for cleaning a roadway surface.

FIG. 1 is a side view of an example of a scraper blade device 10 as suggested herein. The scraper blade device 10 is shown as mounted in front of a generic vehicle 12 for cleaning a roadway surface 14. The exact of vehicle 12 for use with the scraper blade device 10 can be different than the one shown. Likewise, although the scraper blade device 10 is shown as being mounted in front of the vehicle 12, it can also be mounted on the side of a vehicle, under a vehicle or even behind a vehicle.

FIG. 1 shows a scraper blade device 10 designed for removing frozen water materials from the roadway surface 14. However, one can use the scraper blade device 10 for moving other kinds of loose and/or adhering materials. Examples include sand, rocks, gravel and earth, to name just a few. One can also clean a surface with the scraper blade device 10 without mounting it to a vehicle since the scraper blade device 10 can also be used in many other applications. One example of another application is to clean the surface of a conveyor belt transporting one or more materials.

For the sake of simplicity, the following description refers only to the example of the scraper blade device 10 for removing frozen water materials from the roadway surface 14 but it must be understood that the proposed concept is not limited to such context. Another thing to note is than the exact overall shape and configuration of the scraper blade device 10 can vary from one implementation to another.

The expression "roadway surface" is used herein in a generic manner. It can include for instance roadway surfaces made of different materials, for instance asphalt, concrete, stones, gravel, earth, etc. The roadway surfaces can be roads for vehicles, parkings, airport runways, sidewalks, etc. Depending on the roadway surfaces to be cleaned, the scraper blade device 10 can have a width between 2 m and 8 m. Other dimensions are also possible.

The scraper blade device 10 of FIG. 1 is configured for cleaning roadway surfaces at a relatively slow speed, for instance cleaning parkings or roadways in residential areas. A scraper blade device for cleaning highways or the like would generally be shaped with a curved upper portion, as described later in the text.

The scraper blade device 10 illustrated in FIG. 1 is connected to the vehicle 12 using a generic connection assembly 16. The connection assembly 16 has a frame 18 and includes an actuator, for instance a hydraulic actuator 20, for lifting and lowering the scraper blade device 10 with reference to the roadway surface 14. This way, the lowermost edge 10*a* of the scraper blade device 10 can be lifted in and out of engagement with the roadway surface 14. The hydraulic actuator 20 can also control the contact pressure between the lowermost edge 10*a* and the roadway surface 14 by supporting or not a part of the weight of the scraper blade device 10. Other arrangements are possible as well.

The cleaning of the frozen water materials from the roadway surface 14 is generally done as the scraper blade device 10 has its lowermost edge 10*a* in engagement with the roadway surface 14 and moves in a forward direction so as to push the materials as they accumulate in front of the scraper blade device 10. The forward direction is shown in FIG. 1 using arrow 22. The front surface of the scraper blade device 10 is generally referred to as 24.

Depending on the configuration, the scraper blade device 10 can allow the frozen water materials to move laterally as the scraper blade device 10 moves in the forward direction 22. The frozen water materials can be discharged from one or both sides thereof. In other cases, the frozen water materials accumulating on the front surface 24 can be simply pushed over some distance before the vehicle 12 backs up. Some scraper blade devices can also include one or two side panels to facilitate the handling of the frozen water materials.

Some cleaning can be achieved when moving the scraping blade device 10 in a rearward direction but most of the time the cleaning is done as the scraper blade device 10 moves in the forward direction 22. Of course, if the scraper blade device 10 would be located at the rear of the vehicle 12 in an inverted position, the front surface 24 would be facing the rear side of the vehicle 12 and most of the cleaning would thus be done as the vehicle 12 moves backwards. For the sake of simplicity, reference will only be made to the travel direction of the scraper blade device 10, being understood that the forward/rearward directions may sometimes not correspond to that of the vehicle 12.

Figure 2:
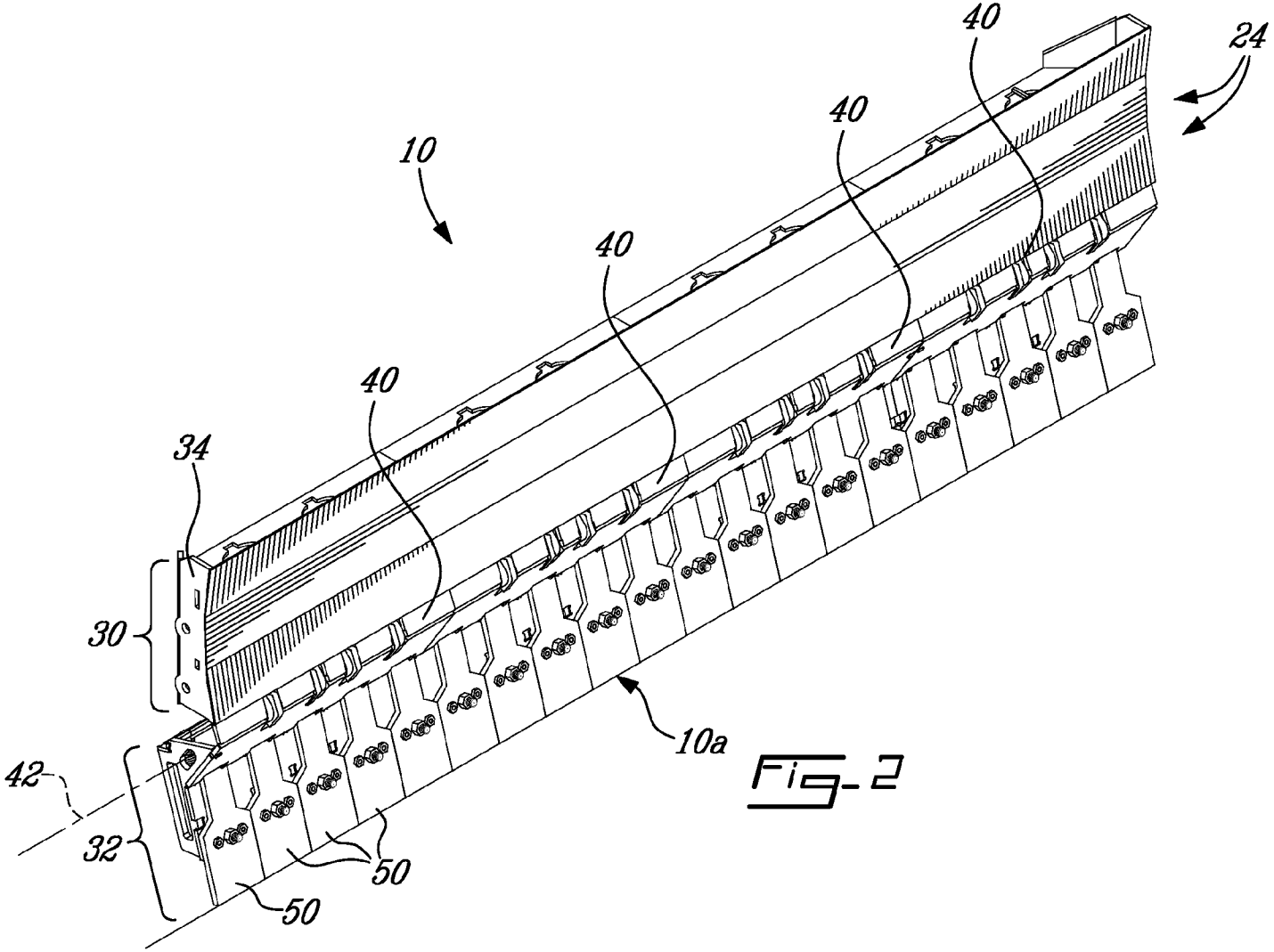
FIG. 2 is a front isometric view of the scraper blade device shown in FIG. 1.

FIG. 2 is a front isometric view of the scraper blade device 10 shown in FIG. 1. The scraper blade device 10 includes an upper blade portion 30 and a bottom blade portion 32 extending widthwise of the scraper blade device 10. The upper blade portion 30 generally defines an upper area of the front surface 24 of the scraper blade device 10. Likewise, the bottom blade portion 32 generally defines a bottom area of the front surface 24. The scraper blade device 10 is connected to the vehicle 12 through the upper blade portion 30.

The upper blade portion 30 can be made of one or more rigid panels forming a continuous surface. A plurality of reinforcing members 34 is provided at the rear to reinforce the upper blade portion 30 (in FIG. 2, most of the reinforcing members 34 are hidden). In the illustrated example, the upper blade portion 30 forms a rigid structure. It can be made using a material such as steel. Other materials and configurations are possible as well.

The bottom blade portion 32 includes one or more widthwise-disposed support frame members 40. Four support frame members 40 are provided in the illustrated example.

Each support frame member 40 is pivotally connected to the upper blade portion 30 and can pivot around a pivot axis 42. The pivot axis 42 is substantially parallel to the lowermost edge 10*a* of the scraper blade device 10. This pivot axis 42 is located at the rear of the front surface 24 of the scraper blade device 10. As will be explained later, the support frame members 40 are independently pivotable between a forward working position (visible in FIG. 2) and a tripped position (visible in FIGS. 8A, 8B and 9). The support frame members 40 are spring loaded toward their forward working position.

The bottom blade portion 32 includes a plurality of widthwise-disposed blade segments 50 that are adjoined and juxtaposed to one another. In the example shown in FIG. 2, each blade segment 50 is in a sliding engagement with a corresponding one of the support frame members 40. Each blade segment 50 can slide in an up and down movement. Each blade segment 50 is independently movable between a downward working position (visible in FIG. 2) and a retracted position (visible in FIGS. 6 and 7). The blade segments 50 are normally in the downward working position. The bottom edges of the blade segments 50 form together the lowermost edge 10*a* of the scraper blade device 10. The side edges between two adjacent blade segments 50 can slide over one another.

Each blade segment 50 can have a width that is for instance between 3 cm (about 1.2 inch) and 100 cm (about 39.4 inches), and preferably between 5 cm (about 2.0 inches) and 20 cm (about 7.9 inches). A width of 10 cm (about 3.9 inches) can be a very good compromise for a scraper blade device designed for cleaning frozen water materials from roadway surfaces. Blade segments 50 can be made of different materials, for instances steel, stainless steel or a polymer, to name just a few. In some applications, for instance when a liquid is the material or one of the materials to clean, the blade segments 50 can be made of a resilient material such as rubber or the like.

As can be seen in FIG. 2, the bottom area of the front surface 24 of the scraper blade device 10 is formed by the exposed front parts of the support frame members 40 and the exposed front parts of the blade segments 50. Also, because the juxtaposed blade segments 50 are adjoined, the front surface 24 of the scraper blade device 10 is uninterrupted from one side to another. Thus, no frozen water material can pass between two blade segments 50.

Figure 3:
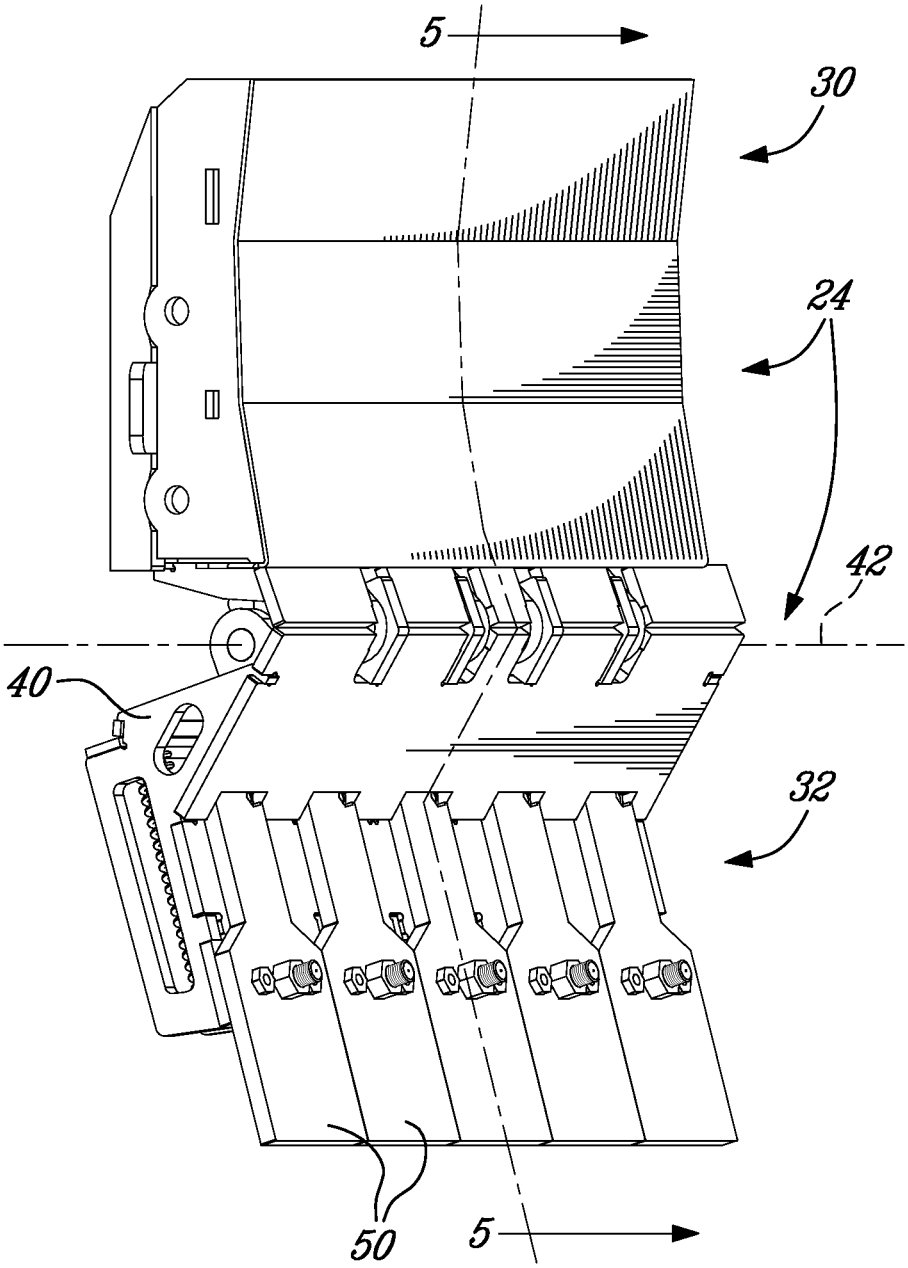
FIG. 3 is a front isometric view of a section of the scraper blade device shown in FIG. 2.
Figure 4:
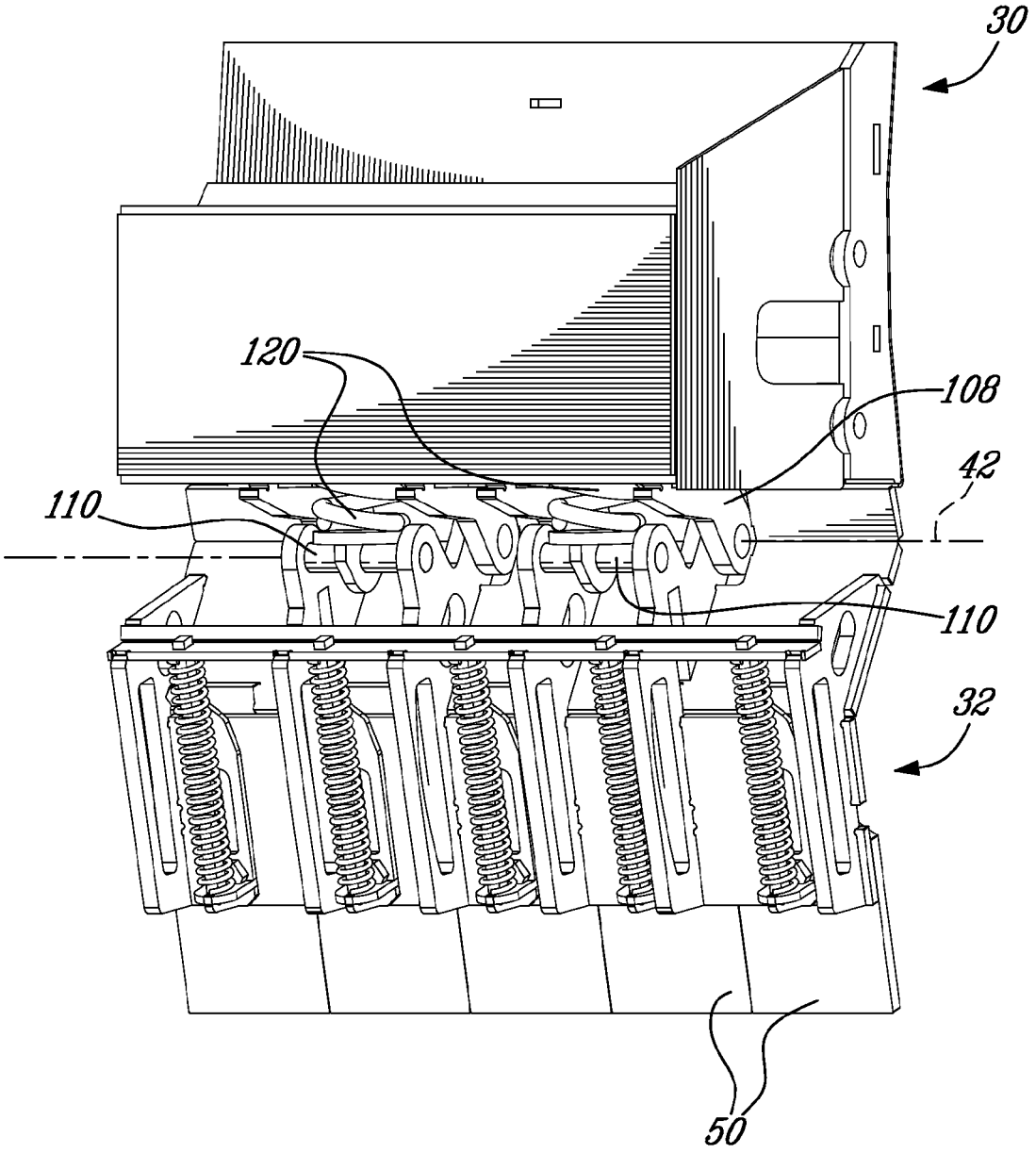
FIG. 4 is a rear isometric view of the section of the scraper blade device shown in FIG. 3.

FIG. 3 is a front isometric view of a section of the scraper blade device 10 shown in FIG. 2. The scraper blade device 10 can be made of a plurality of identical sections connected side-by-side. FIG. 4 is a rear isometric view of the section of the scraper blade device 10 shown in FIG. 3.

Figure 5:
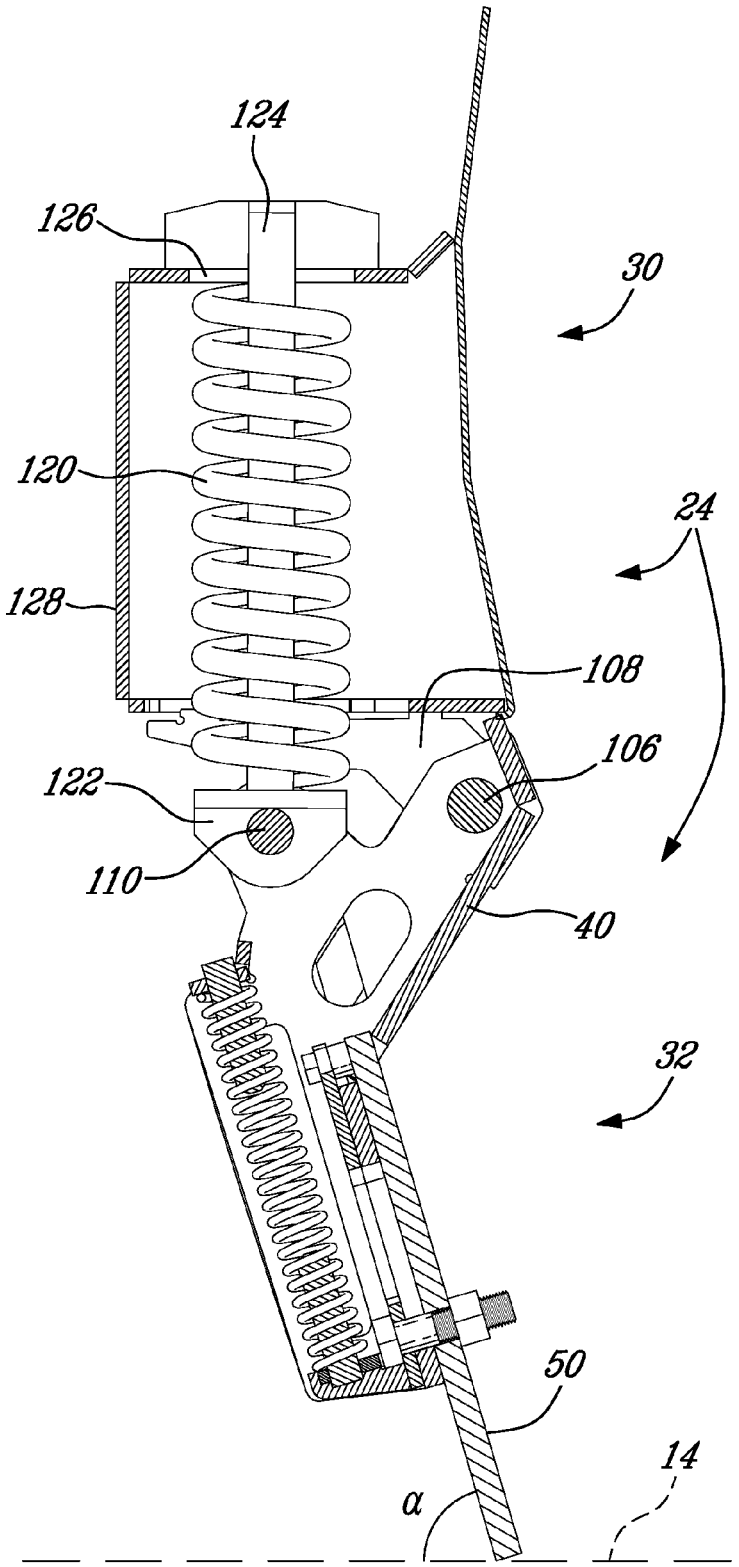
FIG. 5 is a cross section view taken along line 5-5 in FIG. 3.

FIG. 5 is a cross section view taken along line 5-5 in FIG. 3. FIG. 5 shows that the blade segments 50 define an angle $\alpha$ with reference to the roadway surface 14. This angle can be up to 90°.

Figure 6:
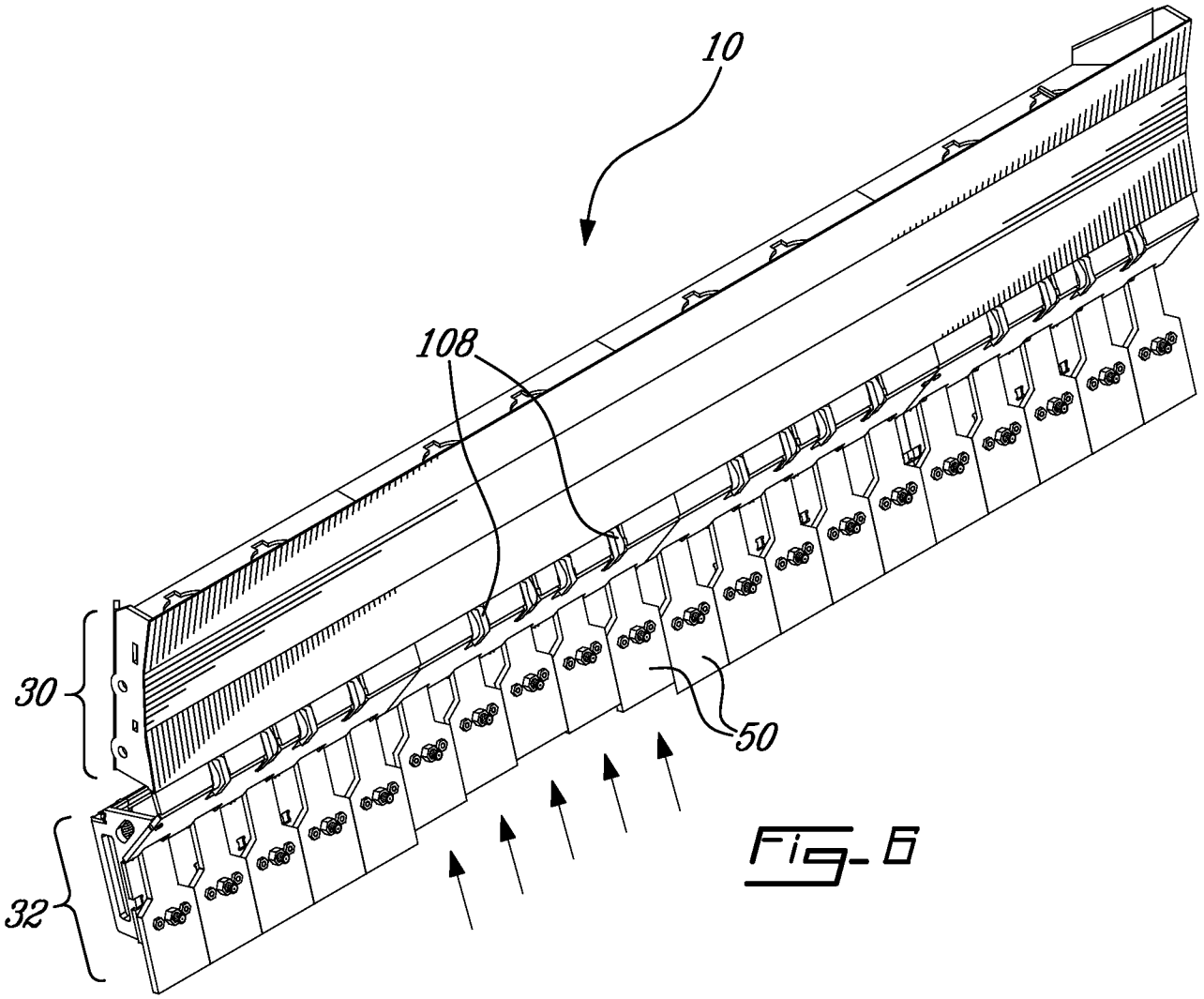
FIG. 6 is a view similar to FIG. 2, showing an example of how the scraper blade device of FIG. 2 reacts to a localized unevenness on the roadway surface.

FIG. 6 is a view similar to FIG. 2 but showing an example of how the scraper blade device 10 of FIG. 2 reacts to a localized unevenness on the roadway surface 14. As aforesaid, most roadway surfaces are not always perfectly smooth, flat and free of obstructions. The height of a roadway surface often varies irregularly from one end of the lowermost edge 10*a* of the scraper blade device 10 to the other. This situation is semi-schematically shown in FIG. 6. The height variations have been exaggerated for the purpose of illustration. Meanwhile, the other blade segments 50 were unaffected. The scraper blade device 10 thus keeps an optimized contact with the roadway surface 14 in spite of the various height variations across its width.

Figure 7:
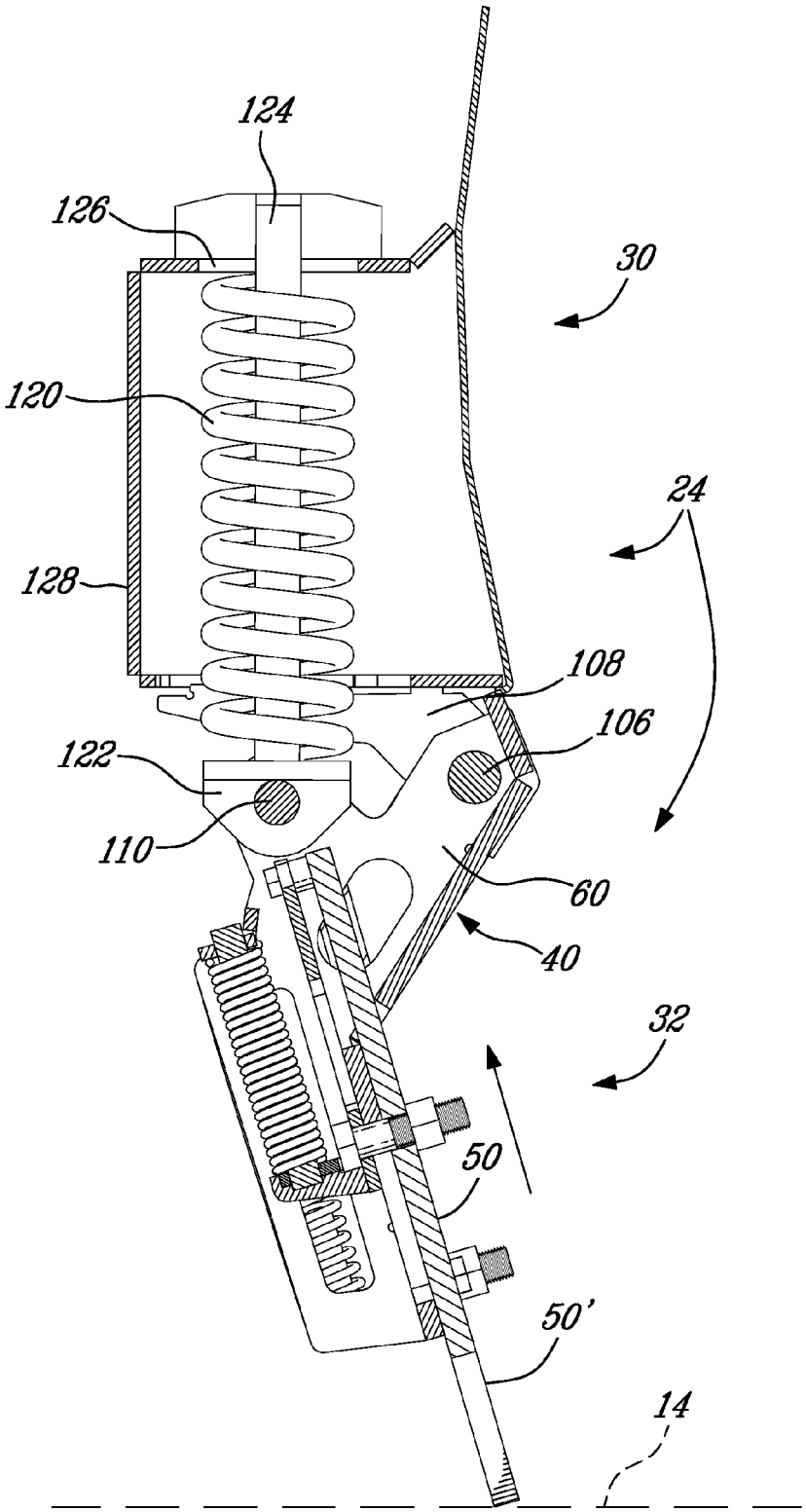
FIG. 7 is a view similar to FIG. 5, showing one of the blade segments in a fully refracted position while an adjacent blade segment is at a normal working position.

FIG. 7 is a view similar to FIG. 5, showing one of the blade segments 50 in a fully retracted position while an adjacent blade segment 50' is at a downward working position.

Figure 8A:
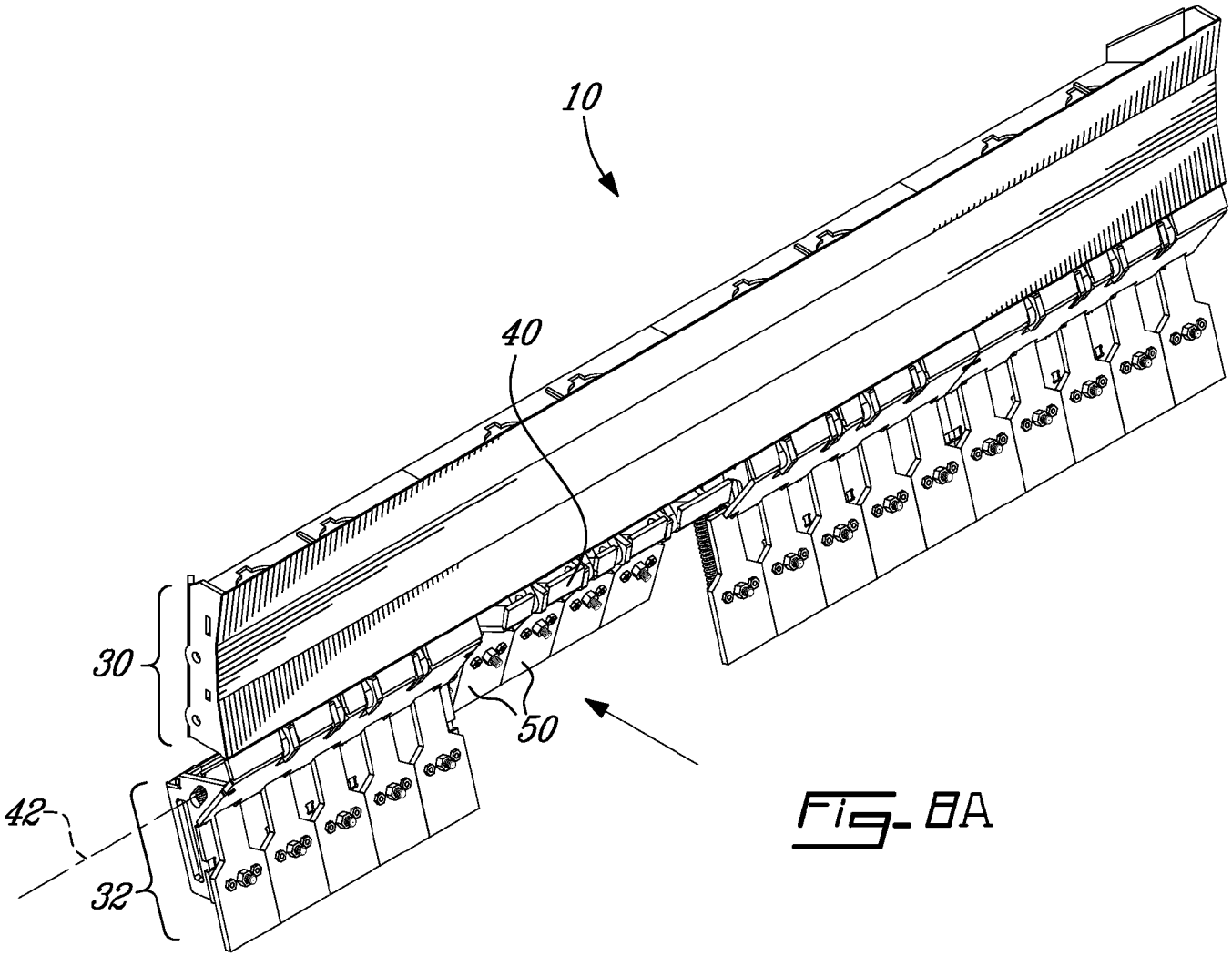
FIG. 8A is a view similar to FIG. 2, showing an example of how the scraper blade device of FIG. 2 reacts to an impact with a localized obstruction on the roadway surface.

FIG. 8A is a view similar to FIG. 2, showing an example of how the scraper blade device 10 of FIG. 2 reacts to an impact with a localized obstruction on the roadway surface 14. An obstruction can be generally defined as something unusual that cannot be compensated by only sliding one or more of the blade segments 50. It can be for instance a sudden change in height of the roadway surface 14 or a foreign object. Examples include an abrupt crack in the pavement, a protruding rim of a manhole and an exposed rock, to name just a few. Frozen ice accumulations adhering on the roadway surface 14 can also sometimes create obstructions. Still, the travel speed of the scraper blade device 10 can play a role in determining if something is an obstruction or not. At a relatively fast travel speed, the blade segments 50 of the scraper blade device 10 has less time to react compared to a relatively slow travel speed and thus, a same irregularly in the roadway surface can be an obstruction in one case and not in the other. An obstruction can also be impacted by the scraper blade device 10 if the operator deviated from the desired path. For instance, curbs can be difficult to locate when they are covered by snow and are often hit.

The impact of the scraper blade device 10 with an obstruction can cause damages if the stress due to the impact exceeds a certain limit. In FIG. 8A, each section of the bottom blade portion 32 is capable of independently pivoting from its normal working position to a tripped position in case of an impact of the scraper blade device 10 with the obstruction. This mitigates the damages to the scraper blade device 10. Also, if the obstruction is only hit by fewer than all sections, the other sections can remain in operation, as depicted in FIG. 8A. The section hitting the obstruction pivots towards the rear to pass it. The pivot angle will depend on the relative height of the obstruction and the travel speed but as soon as the obstruction 14*a* is cleared, the section will return to its normal working position.

Figure 8B:
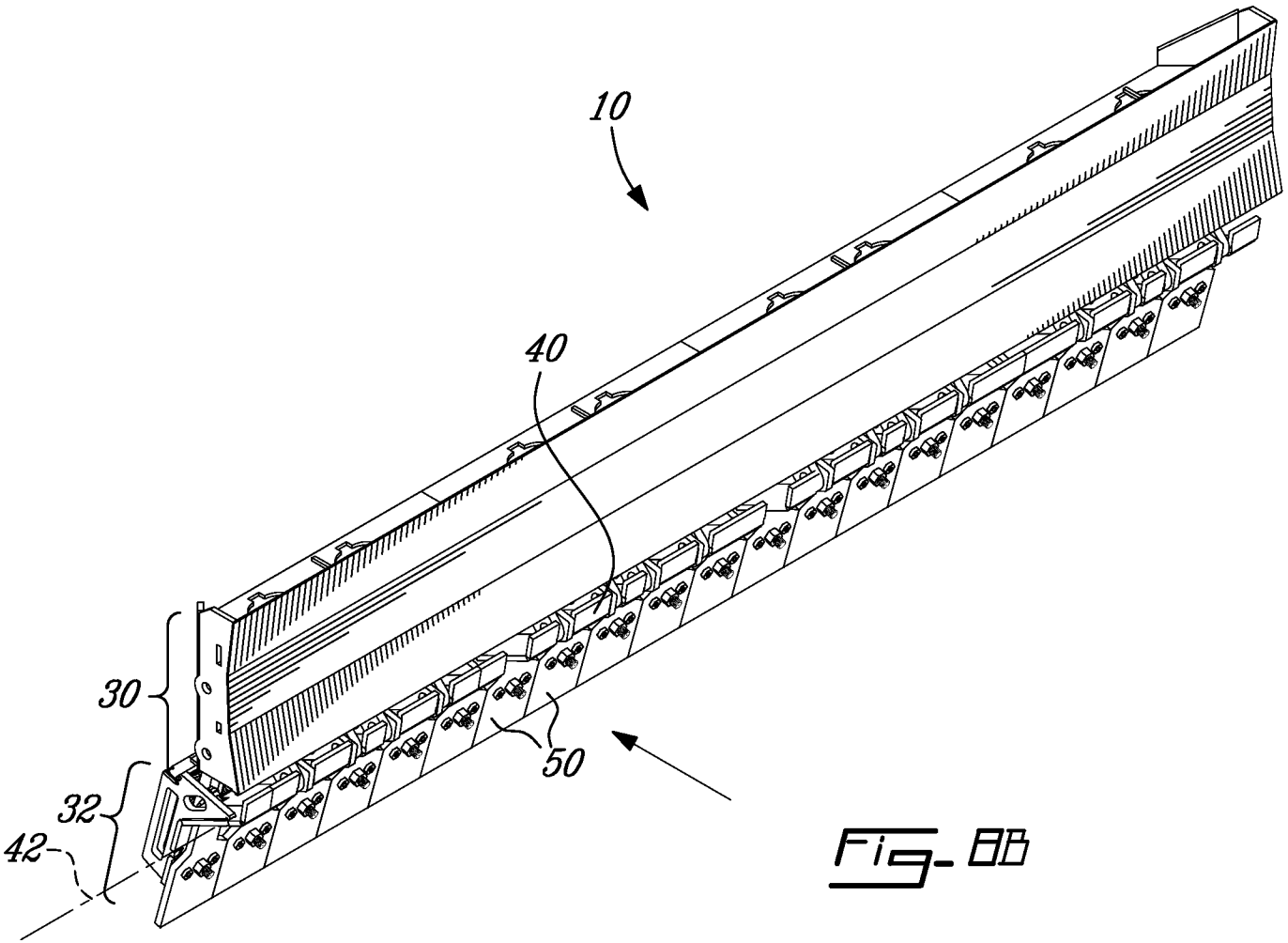
FIG. 8B is a view similar to FIG. 8A, showing an example of a scraper blade device where all blade segments are pivoted after an impact with an obstruction.

FIG. 8B is a view similar to FIG. 8A, showing an example of a scraper blade device where all blade segments 50 are pivoted after an impact with an obstruction. This can be the case if only a single support frame member 40 is provided for the entire width or if all support frame members 40 are rigidly connected together.

Figure 9:
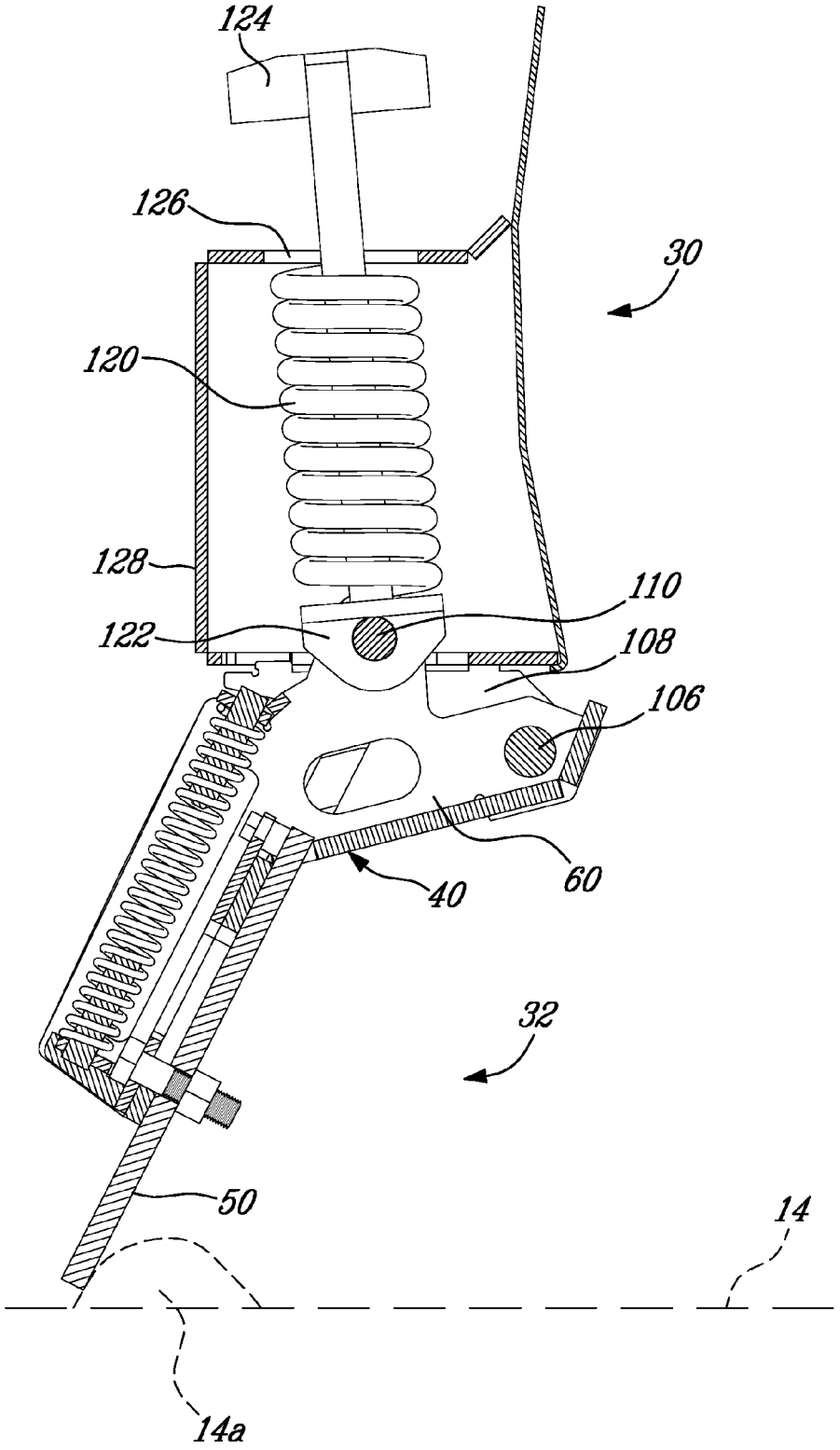
FIG. 9 is a view similar to FIG. 5, showing the bottom blade portion of the section in a tripped position immediately after an impact with an obstruction.

FIG. 9 is a view similar to FIG. 5, showing the bottom blade portion of the section in a tripped position immediately after an impact with an obstruction.

Figure 10:
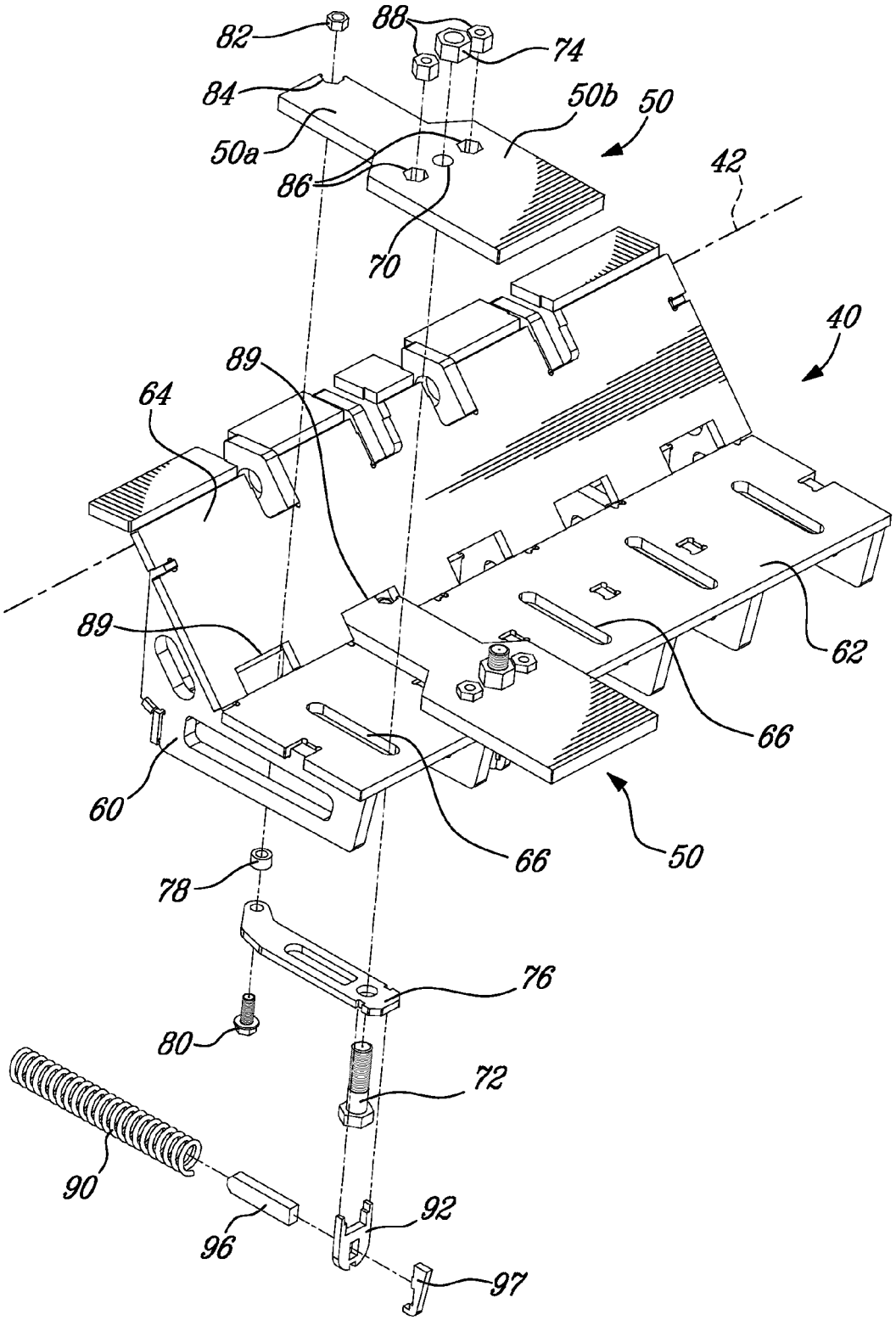
FIG. 10 is a front isometric and partially exploded view of the bottom blade portion of the scraper blade device section shown in FIG. 3.
Figure 11:
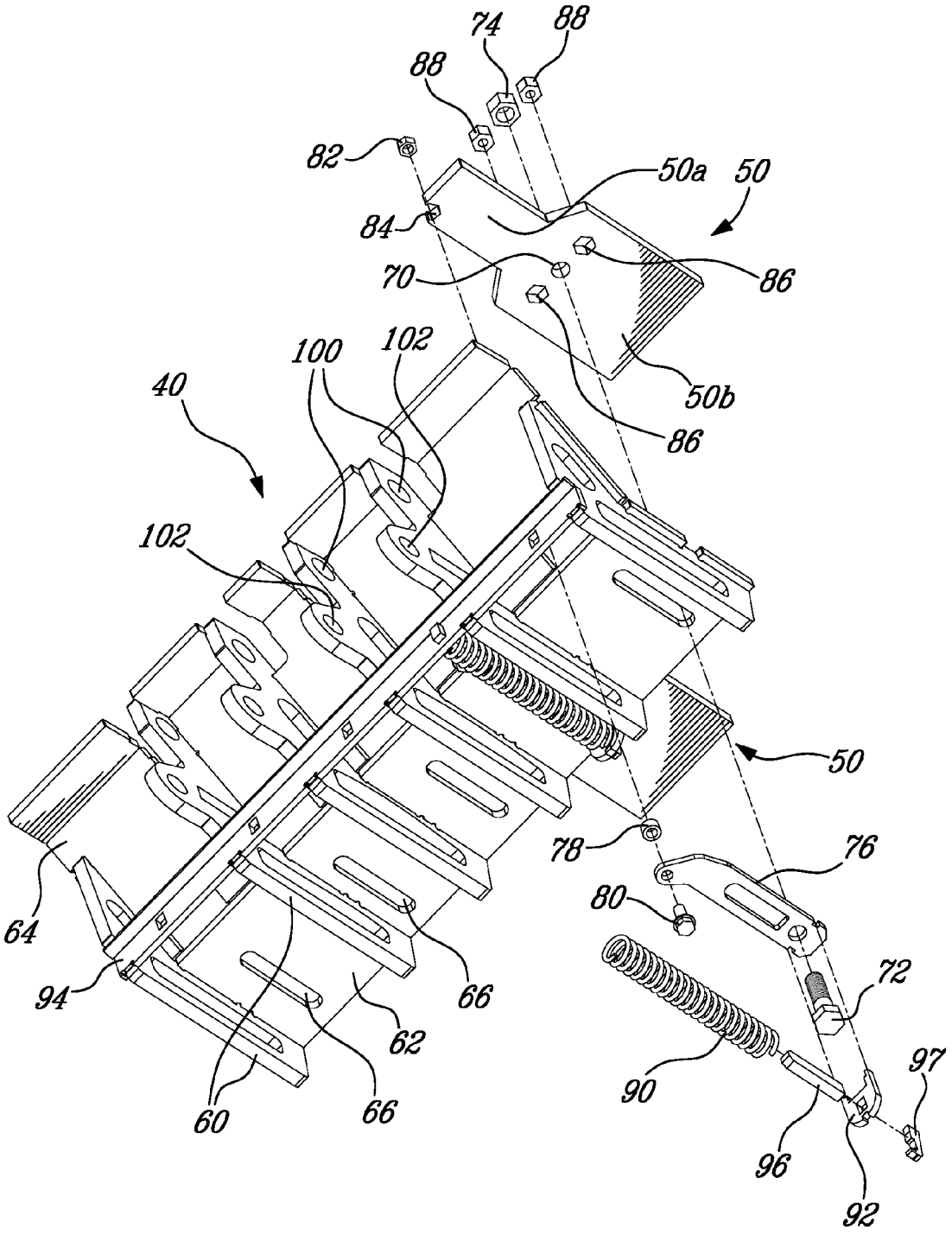
FIG. 11 is a rear isometric and partially exploded view of what is shown in FIG. 10.

FIG. 10 is a front isometric and partially exploded view of a section of the bottom blade portion 32 of the scraper blade device 10 shown in FIG. 3. FIG. 11 is a rear isometric and partially exploded view of what is shown in FIG. 10. Only two of the blade segments 50 are shown in FIGS. 10 and 11. The other blade segments 50 and their corresponding components were not drawn for the purpose of clarity.

FIGS. 10 and 11 show the construction details of the support frame member 40 used in the example of the scraper blade device 10 of FIG. 2. This support frame member 40 includes a plurality of spaced-apart rear braces 60 to which is connected a first front plate 62 and a second front plate 64, both having front surfaces defining an obtuse angle between them (i.e. an angle of more than 90° and less than 180°). The first front plate 62 includes a plurality of elongated slots 66, one for each blade segment 50 mounted to the support frame member 40. The slots 66 extend parallel to one another in a direction that is substantially perpendicular to the lowermost edge 10*a* of the scraper blade device 10.

The illustrated support frame member 40 is designed to hold five blade segments 50. However, it is possible to design the support frame member 40 with a different number of blade segments 50. Still, although the scraper blade device 10 illustrated in FIG. 2 has four identical support frame members 40 with each five blade segments 50, one can use one or more support frame members 40 having a different number of blade segments 50 compared to the others.

As can be seen, each blade segment 50 has an upper portion 50*a* and a bottom portion 50*b* having a rectangular cross section. The upper portion 50*a* is narrower in width than the bottom portion 50*b*. The bottom portion 50*b* includes a central hole 70 for receiving a retaining bolt 72. The retaining bolt 72 has a threaded end projecting out of the front side face of the corresponding blade segment 50 when the parts are assembled. A nut 74 holds the retaining bolt 72 but is not tighten enough to prevent the blade segment 50 from sliding. The retaining bolt 72 also holds one end of an elongated arm 76 located on the back side of the first front plate 62. The elongated arm 76 extends substantially parallel to the corresponding slot 66.

In the illustrated example, the opposite end of the elongated arm 76 holds a cylindrical bushing 78. The bushing 78 is attached by a bolt 80 and a corresponding nut 82. A notch 84 in the upper corner of the blade segment 50 provides room for the nut 82.

The illustrated blade segments 50 each include two holes 86, one on each side of the central hole 70, to receive a corresponding grease fitting 88. This way, the interface between the blade segments 50 and the front surface of the first front plate 62 can be lubricated using grease injected under pressure.

The second front plate 64 includes a plurality of apertures 89 on the edge adjacent to the first front plate 62. Each of these apertures 89 allows the upper portion 50*a* of a corresponding one of the blade segments 50 to extend through the second front plate 64. Also, when the blade segment 50 is in the bottom position, the bushing 78 is located adjacent to the interior of the aperture 89.

The illustrated example includes a plurality of first spring mechanisms connected to the blade segments 50. Each first return spring mechanism cooperates with a single one of the blade segments 50 and urges it away from the upper blade portion 30 (i.e. towards the roadway surface 14).

In the illustrated example, the first return spring mechanisms each include a helical compression spring 90. Each spring 90 extends between a flange 92 welded to the elongated arm 76 near the retaining bolt 72 and a support bar 94 (FIG. 11) extending widthwise behind the braces 60 of the support frame member 40. A first pin 96 and a corresponding clip 97 are welded to the flange 92 and a second pin 98 is welded to the support bar 94 to hold respective ends of the spring 90.

It should be noted that the first return spring mechanism can be constructed differently. Other kinds of springs or force-generating arrangements can be used as well, for instance a pneumatic actuator.

As best shown in FIG. 11, the braces 60 at the center of the support frame member 40 each include a set of two spaced-apart holes 100, 102. The holes 100 are in registry with one another and the holes 102 are in registry with one another. The holes 100 form the pivot axis 42. The holes 100 receive one or more axles 106. The axles 106 connect the support frame member 40 to brackets 108 of the upper blade portion 30. The brackets 108 are shown in FIGS. 4 to 9.

The holes 102 of the braces 60 also receive axles 110, each extending between two adjacent ones of the holes 102, as best shown in FIG. 4.

In the illustrated example, the bottom blade portion 32 includes a plurality of second return spring mechanisms mounted between each support frame member 40 and the upper blade portion 30. These second return spring mechanisms are each connected to a corresponding one of the support frame members 40 at a location at the rear of the axles 106, thus at the rear of the pivot axis 42. It includes one or more helical compression springs 120 extending from a corresponding one of the axles 110 and a fixed location at the rear of the upper blade portion 30, as shown in FIGS. 5, 7 and 9. Two springs 120 are provided for each support frame member 40 of the illustrated example. The bottom end of each spring 120 is connected to the corresponding axle 110 using a holding member 122. The springs 120 are each held in place by a central arm 124 extending out of a hole 126 made at the top of a protective casing 128. It is possible to use a different number of springs. Other kinds of springs or force-generating arrangements can be used as well, for instance a pneumatic actuator.

In use, the springs 120 urge the support frame members 40 toward their normal working position. The support frame member 40 is prevented from pivoting further towards the front since the enlarged upper end of the arms 124 engage the top of the rim of their corresponding hole 126.

Figure 12:
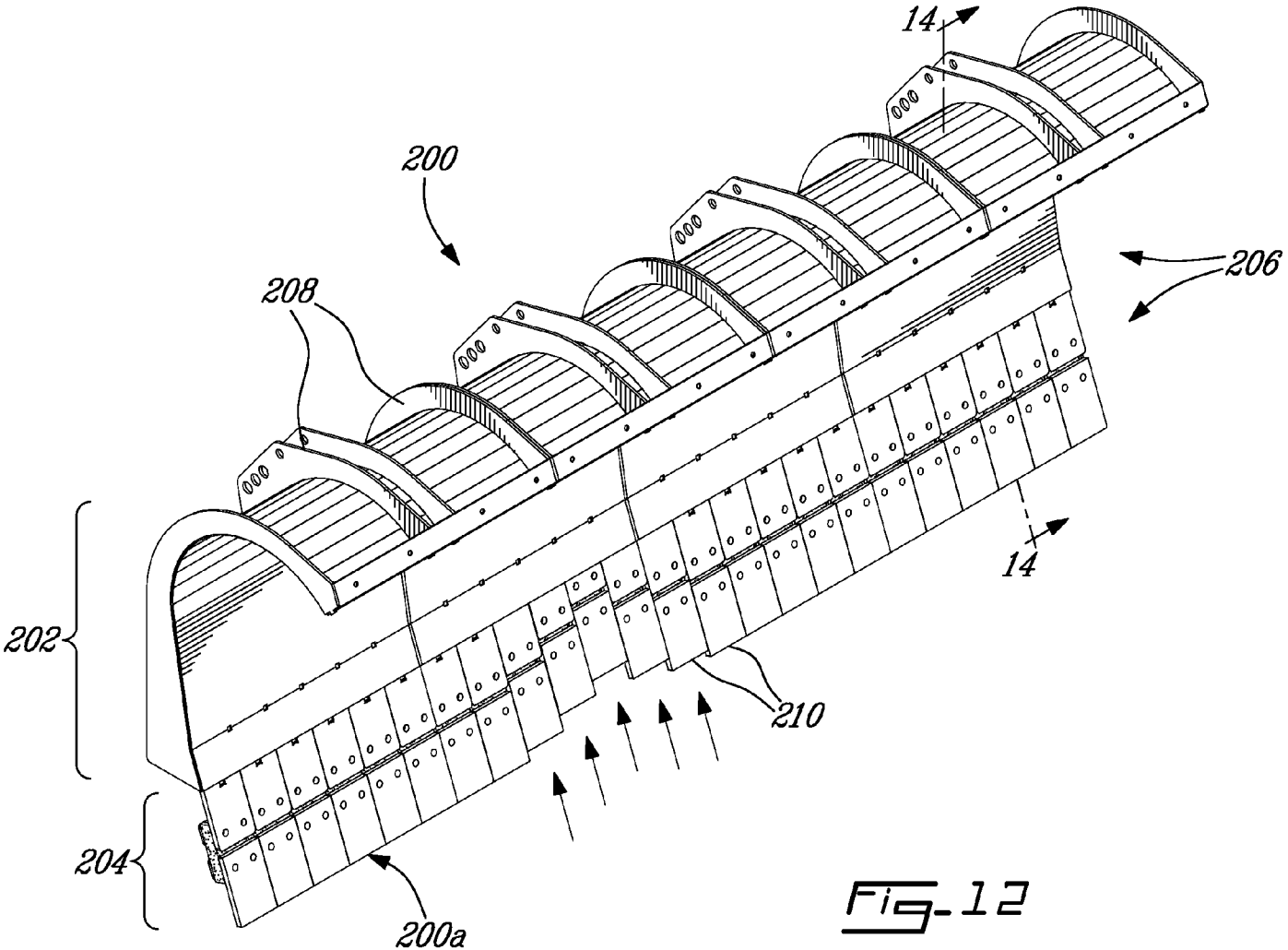
FIG. 12 is a view similar to FIG. 6, showing another example of a scraper blade device as suggested herein.

FIG. 12 is a view similar to FIG. 6 but showing another example of a scraper blade device as suggested herein. For the sake of clarity, this scraper blade device is referred to as 200. The lowermost edge of this scraper blade device 200 is identified as 200*a*.

Figure 13:
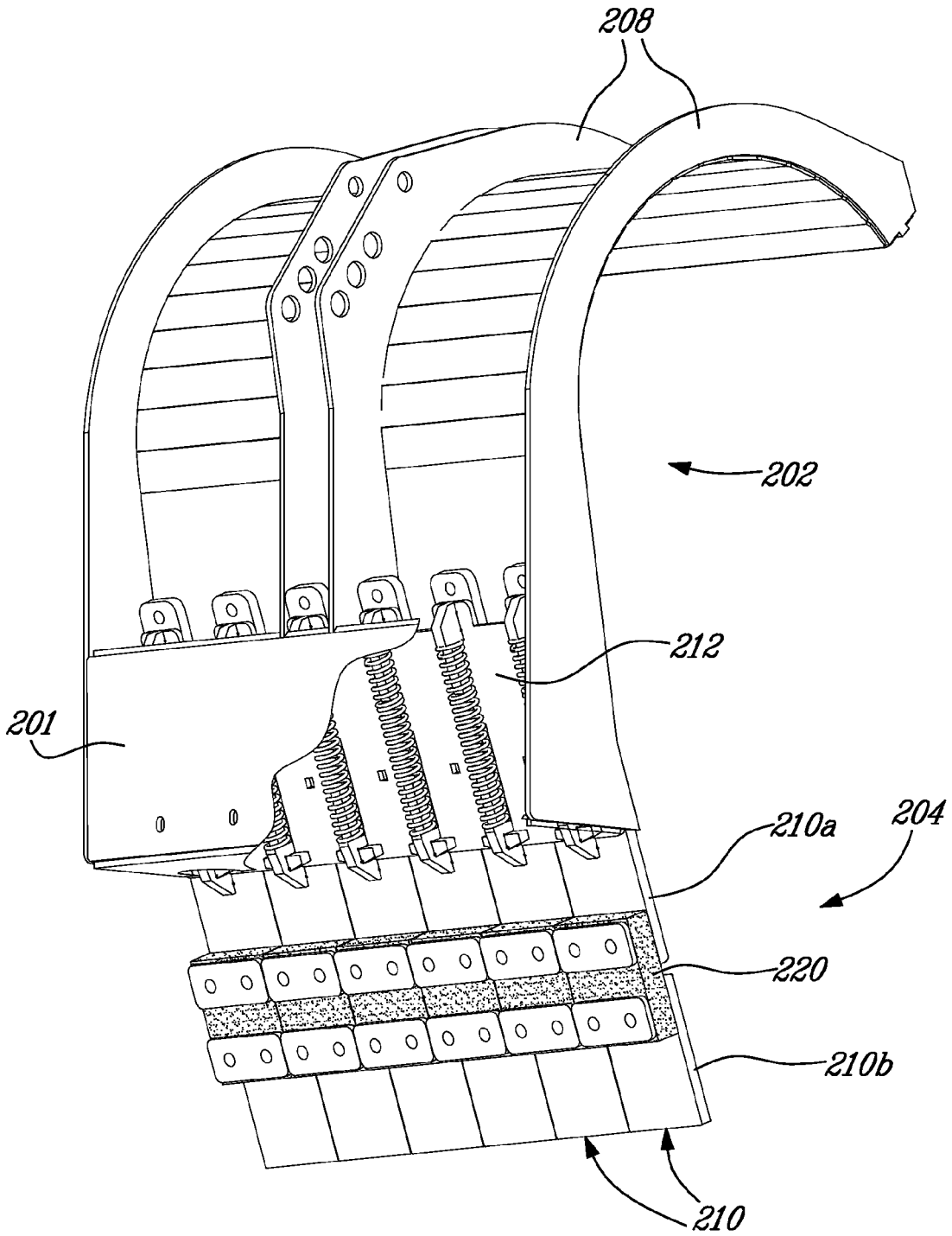
FIG. 13 is a rear isometric view of a section of the scraper blade device shown in FIG. 12.

FIG. 13 is a rear isometric view of a section of the scraper blade device 200 shown in FIG. 12. A portion of the rear protective cover 201 has been removed to show the parts therein.

The scraper blade device 200 includes an upper blade portion 202 and a bottom blade portion 204. This upper blade portion 202 has a curved shape that is useful for cleaning public roadway surfaces, for instance municipal roads or highways to name just a few, at a relatively fast speed. The upper blade portion 202 and the bottom blade portion 204 define together the front surface 206 of the scraper blade device 200. FIG. 12 shows the plurality of reinforcing members 208 of the upper blade portion 202.

Figure 19:
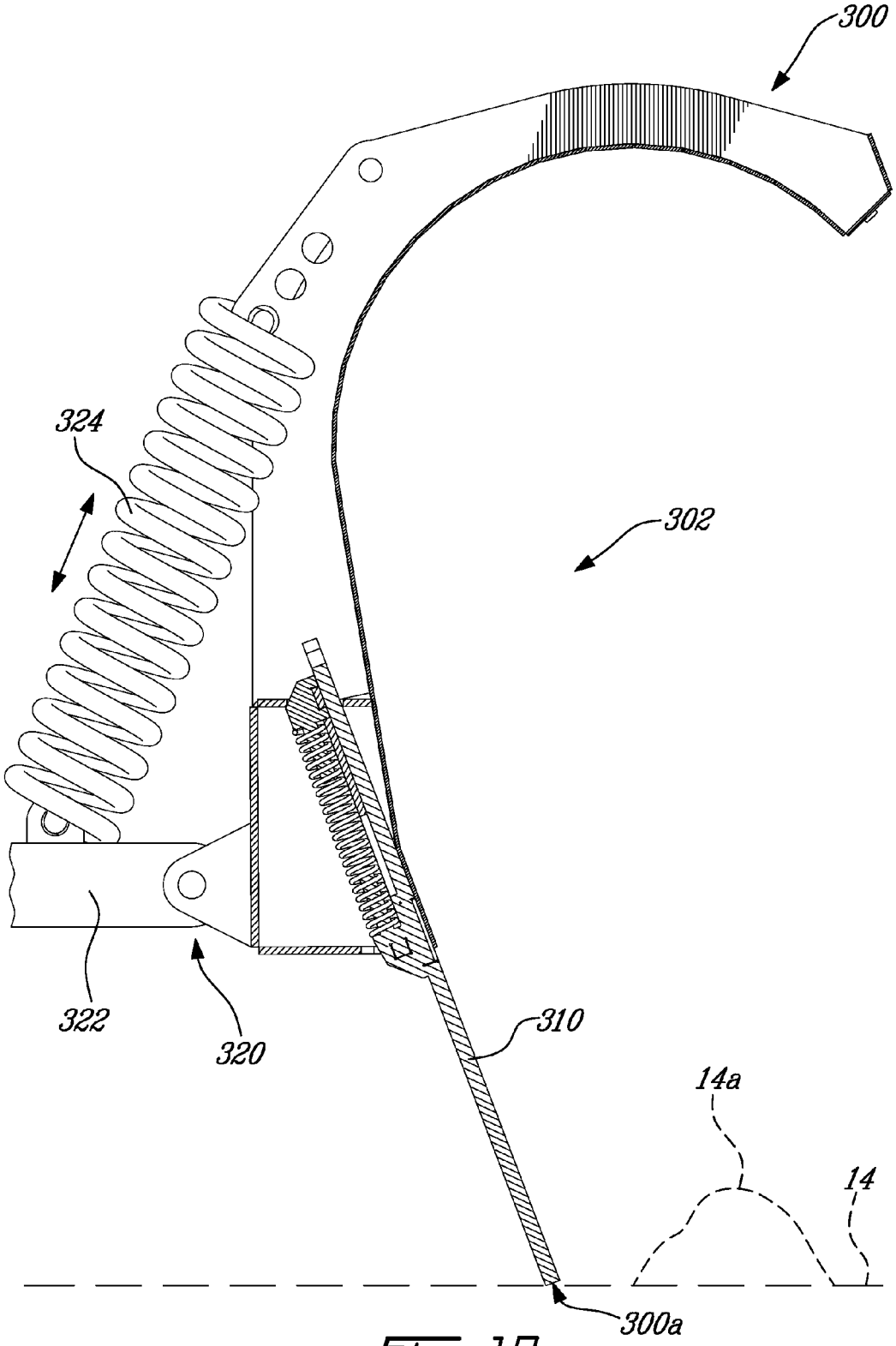
FIG. 19 is a view similar to FIG. 14, showing another example of a scraper blade device as suggested herein.

The scraper blade device 200 also includes a plurality of widthwise-disposed and longitudinally-displaceable blade segments 210 that are adjoined and juxtaposed to one another. Each blade segment 210 is in a sliding engagement with a corresponding support frame member 212 (FIG. 19). Each blade segment 210 is movable between a working position (visible for instance in FIG. 13) and a retracted position (visible in FIG. 17). The blade segments 210 are normally in their working position. The bottom edges of the blade segments 210 form together the lowermost edge 200*a* of the scraper blade device 200. As can be seen, the bottom area of the front surface 206 of the scraper blade device 200 is formed by the exposed parts of the front side faces of the blade segments 210.

Each blade segment 210 includes two portions, namely an upper portion 210*a* and a bottom portion 210*b* that are connected together using a flexible member 220. The flexible member 220 can be made for instance a polymeric material. An example of polymeric material is a urethane material or the like. Other kinds of materials are possible as well. Still, one can provide a spring arrangement as the flexible member 220.

The illustrated flexible member 220 is removably connected at the rear of each blade segment 210, for instance using bolts, screws or rivets. Other kinds of connectors are possible as well. In the illustrated example, backplates 222, 224 are provided on the rear side of the flexible members 220 to distribute the forces from the connectors.

Each support frame member 212 is rigidly attached to the upper blade portion 202. It is possible to provide one or more support frame members 212. For instance, it is possible to provide only one support frame member 212 extending the full width of the scraper blade device 200, or to provide two or more support frame members 212 disposed in juxtaposition. In the illustrated example, a plurality of support frame members 212 are provided. The support frame members 212 are hidden under the protective casing 201.

Figure 14:
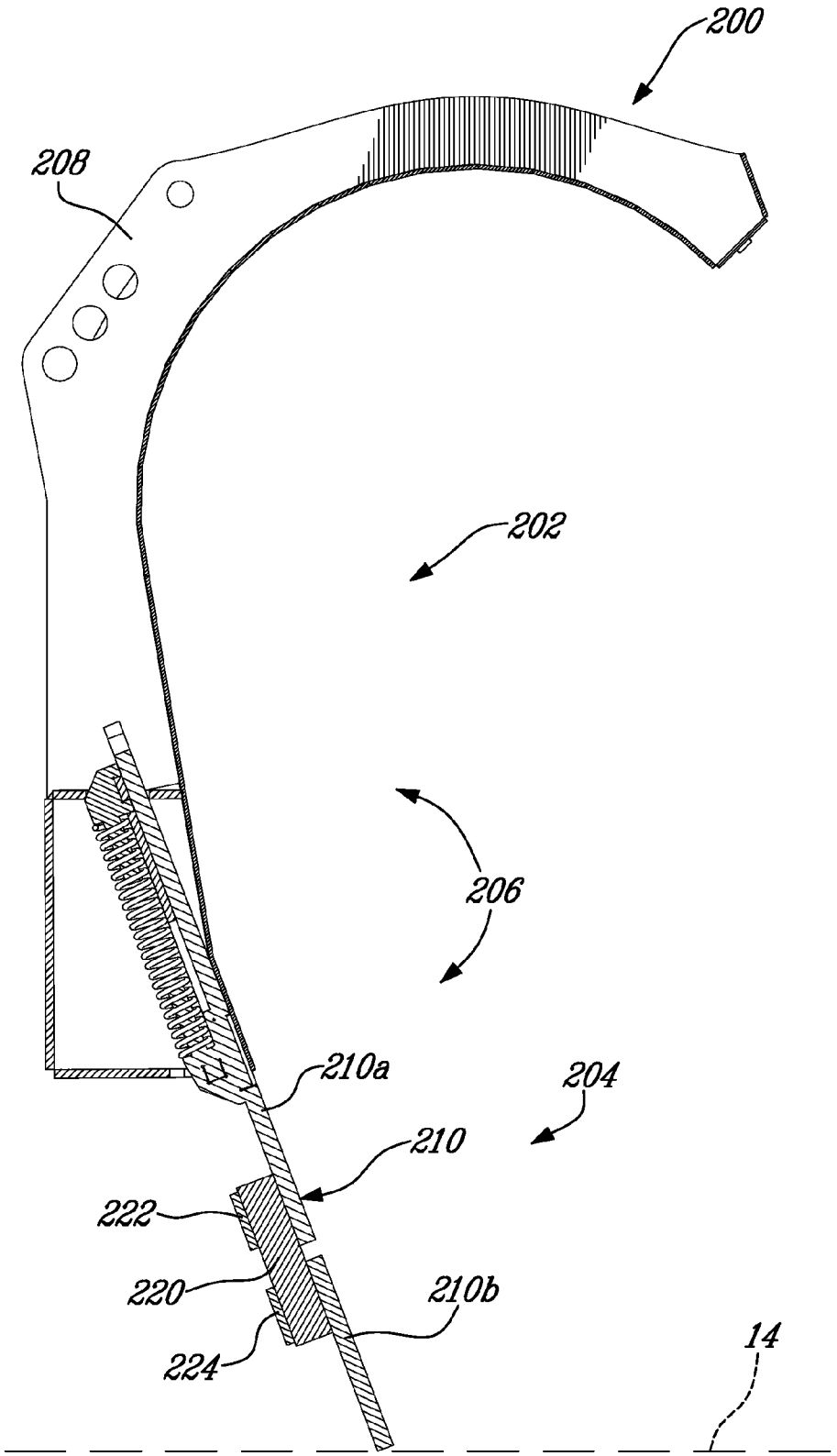
FIG. 14 is a cross section view taken along line 14-14 in FIG. 12.

FIG. 14 is a cross section view taken along line 14-14 in FIG. 12. As can be seen, the blade segment 210 includes a return spring mechanism to urge the blade segment 210 towards the bottom. The mechanism illustrated includes a helical compression spring 230 extending between the blade segment 210 and the support frame member 212. Other arrangements are possible as well.

Figure 15:
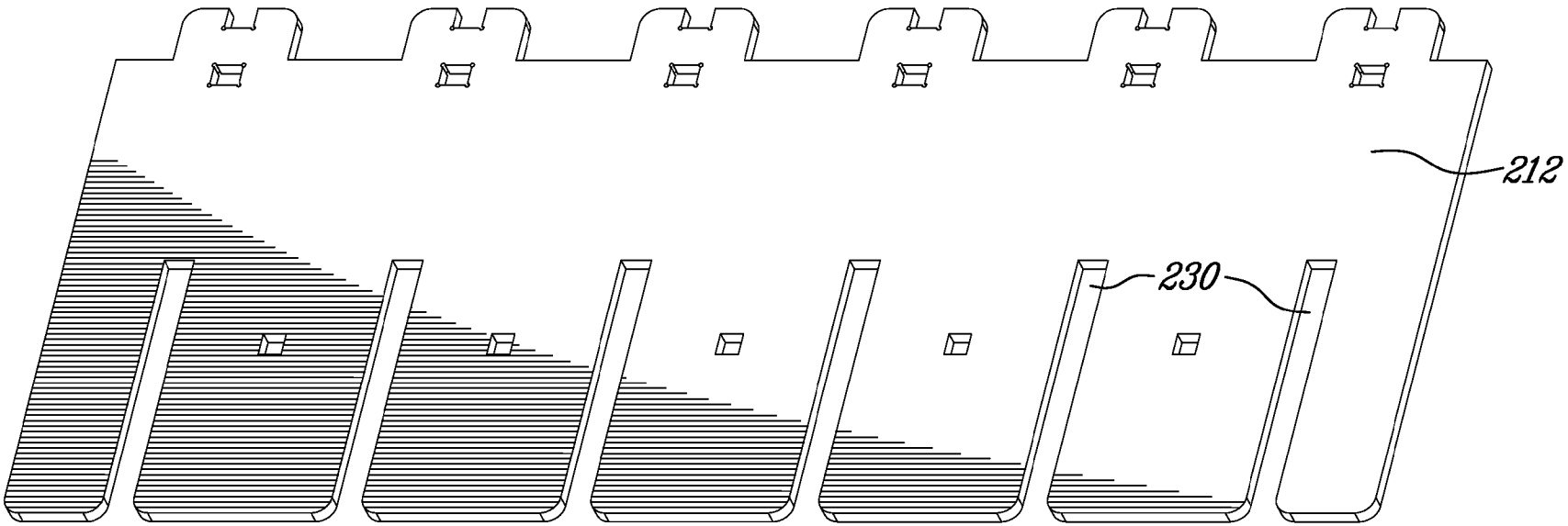
FIG. 15 is an isometric view of one of the support frame members used in the scraper blade device shown in FIG. 12.
Figure 16:
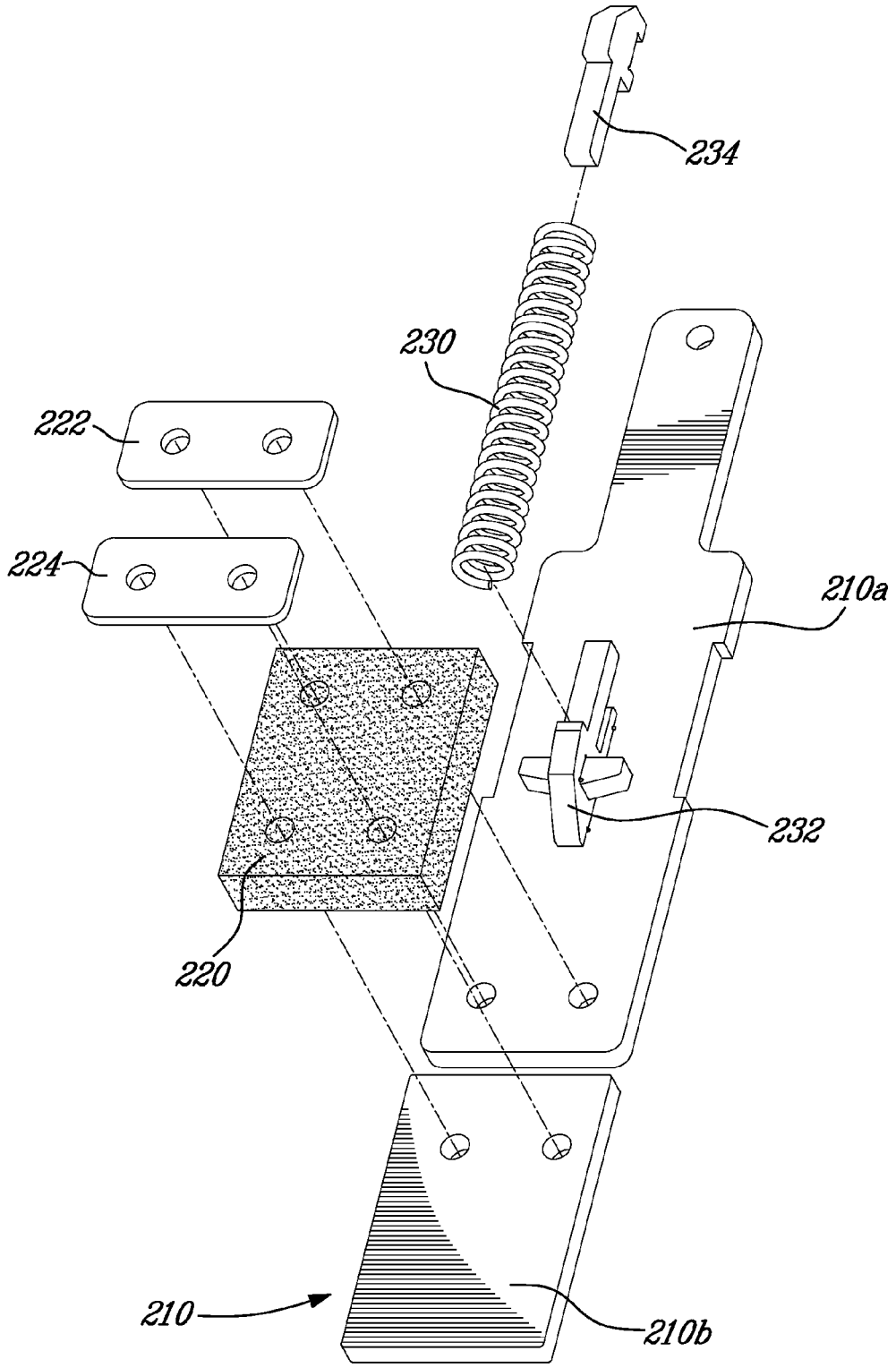
FIG. 16 is a rear isometric and exploded view of one of the blade segments used in the scraper blade device shown in FIG. 12.

FIG. 15 is an isometric view of one of the support frame members 212 used in the scraper blade device 200 shown in FIG. 12. FIG. 16 is a rear isometric and exploded view of one of the blade segments 210 used in the scraper blade device 200 shown in FIG. 12.

The illustrated blade segment 210 includes one central flange 232 rigidly connected at the back thereof. The flange 232 is designed to be inserted in a corresponding one of the spared-apart and parallel slots 240 of the support frame member 212. This arrangement acts as a guide for the blade segment 210. The spring 230 is connected at its upper end to a flange 234 that is welded to the upper edge of the support frame member 212.

Figure 17:
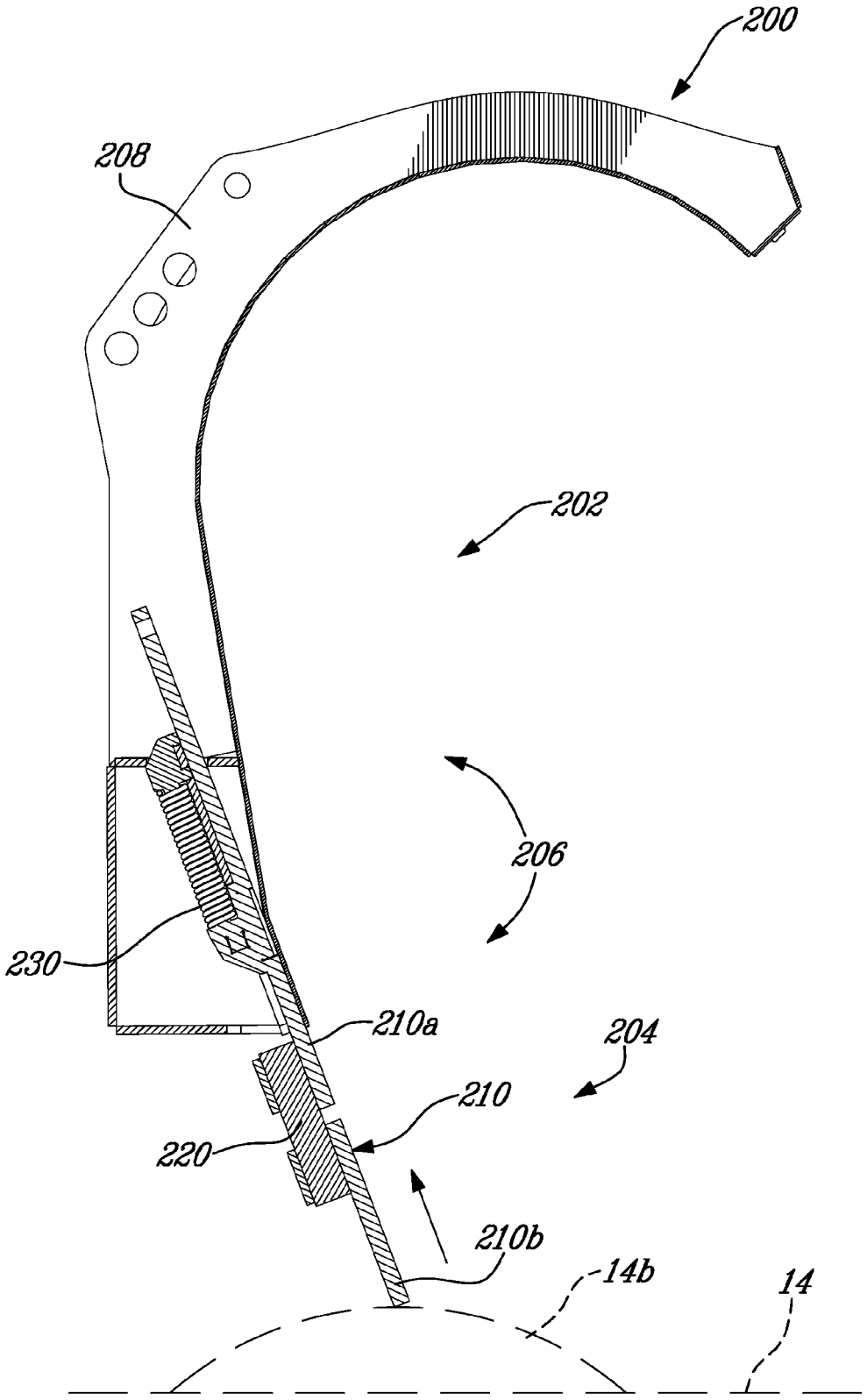
FIG. 17 is a view similar to FIG. 14 but showing the blade segment in a retracted position as it passes over a bump on the roadway surface.

FIG. 17 is a view similar to FIG. 14 but showing the blade segment 210 in a retracted position as it passes over a bump 14*b* on the roadway surface 14.

Figure 18:
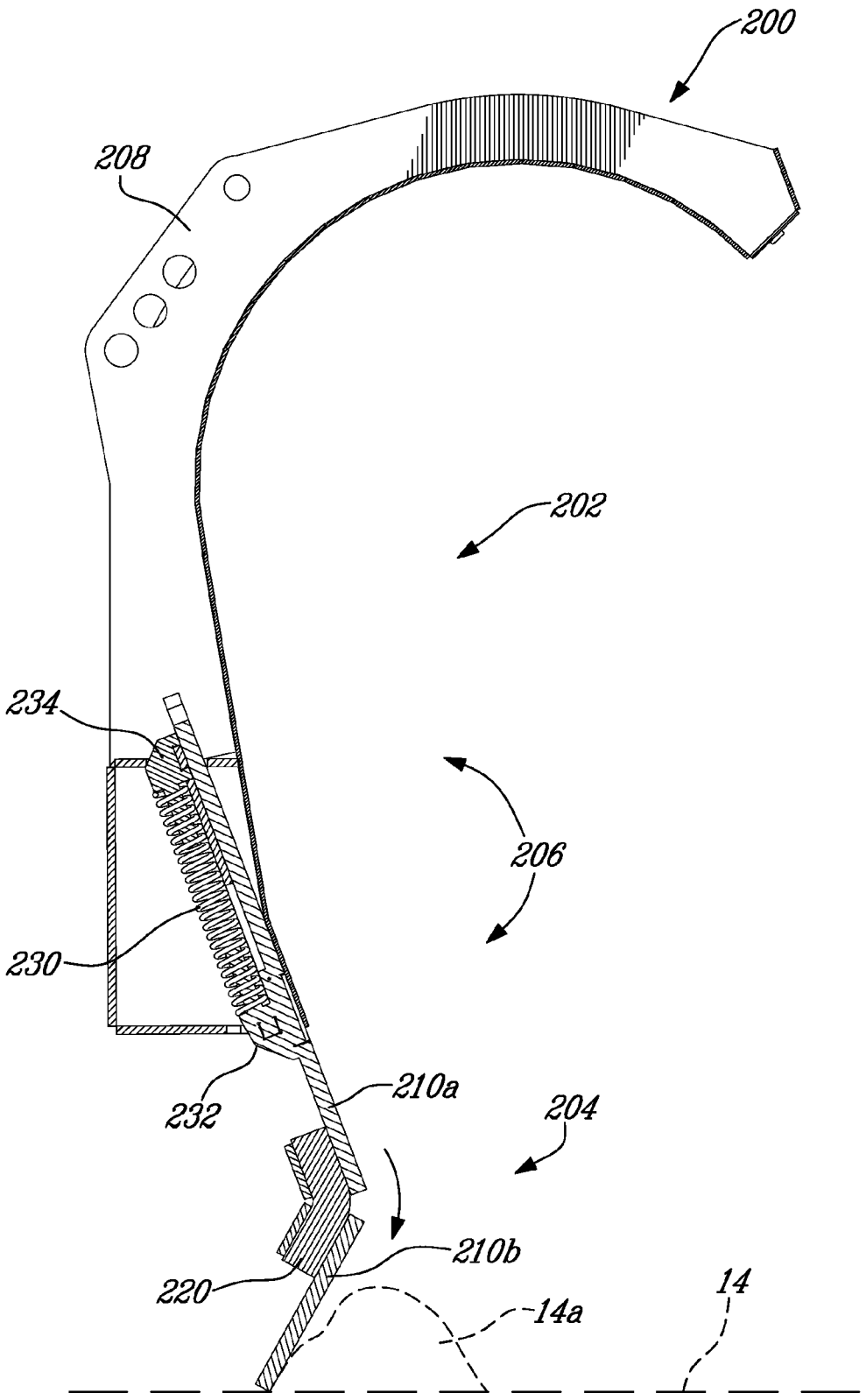
FIG. 18 is a view similar to FIG. 16, showing how the blade segment reacts to an impact with a localized obstruction on the roadway surface.

FIG. 18 is a view similar to FIG. 16, showing how the blade segment 210 reacts to an impact with a localized obstruction 14*a* on the roadway surface 14. As can be seen, the bottom portion 210*b* of the blade segment 210 pivoted toward the rear with reference to the upper portion 210*a* as the flexible member 220 bended. However, since the flexible member 220 is also elastic, the bottom portion 210*b* will return to its normal working position once the obstruction 14*a* is cleared.

FIG. 19 is a view similar to FIG. 14, showing another example of a scraper blade device as suggested herein. For the sake of clarity, this scraper blade device is referred to as 300. The lowermost edge of this scraper blade device 300 is identified as 300*a*.

Unlike the scraper blade device 200, blade segments 310 of the scraper blade device 300 do not have flexible members. They can slide up and down like the blade segments 210 to compensate for the unevenness of the roadway surface 14 but the pivot movement in case of an impact with an obstruction 14*a* is made possible using a pivot connection 320 located between the scraper blade device 300 and a frame member 322 attaching the scraper blade device 300 to a vehicle (not shown) or another supporting structure. In this example, the whole scraper blade device 300 pivots in case of an impact. A tension spring 324 is mounted between the back of the scraper blade device 300 and the frame member 322. The spring 324 provides the return force to pivot the scraper blade device 300 back to its normal working position after an impact. Other kinds of springs and/or configurations are also possible.

The scraper blade device 10 can be made using a manufacturing process that includes any one of the following acts or combinations thereof: cutting, bending, punching, welding, bolting, gluing, painting.

Overall, the proposed concept provides a way to increase the efficiency of the cleaning compared to existing arrangements. Tests showed that on a roadway surface, the overall efficiency of the cleaning of frozen water materials can be increased from about 40% (when using a conventional blade) to an average of about 80%. This yields several advantages, including for instance reducing the amount of de-icing chemicals, increasing road safety, etc.

The proposed concept can also provide other advantages, including: an improved mechanical strength, a facilitated maintenance in case of a failure of a part, the possibility of using the device 10 even in case of a partial failure, an increased travel speed while in use, an increased overall fuel efficiency, a reduction of the damages and wear to the roadway surfaces, a reduction of the amounts of de-icing chemicals released in the environment and a maintenance cost reduction for the operators.

The present detailed description and the appended figures are meant to be exemplary only. A skilled person will recognize that variants can be made in light of a review of the present disclosure without departing from the proposed concept.

What is claimed is:

1. A scraper blade device for cleaning a surface when moving in a forward travel direction relative to the surface, the scraper blade device having a front surface and a lowermost edge, the scraper blade device including:

an upper blade portion generally defining an upper area of the front surface of the scraper blade device; and a bottom blade portion generally defining a bottom area of the front surface of the scraper blade device, the bottom blade portion including a plurality of widthwise-disposed blade segments that are adjoined and juxtaposed to one another, each blade segment having an upper portion, a bottom portion, a front side face and a rear side face, the bottom portion of each blade segment including a bottom edge and the bottom edges of the blade segments forming together the lowermost edge of the scraper blade device, the bottom edge of each blade segment being independently slidingly movable in an up and down movement with reference to the bottom edges of other blade segments in the bottom blade portion, the bottom edges being biased towards a downward working position by a plurality of first bias mechanisms, the blade segments being also pivotally movable rearwards, with reference to the forward travel direction, around a pivot axis that is substantially parallel to the lowermost edge of the scraper blade device, each bottom edge having a forward working position and a rearward tripped position where each bottom edge in the rearward tripped position is backwards underneath the scraper blade device, with reference to the forward travel direction, compared to the forward working position of the bottom edge, the blade segments being biased forwards around the pivot axis, with reference to the forward travel direction, by at least one second bias mechanism to urge the bottom edges of the blade segments towards the forward working position.

2. The device as defined in claim 1, wherein the bottom edges are also pivotable with reference to the upper blade portion.

3. The device as defined in claim 2, wherein the bottom edges of at least some of the blade segments are pivotable out of alignment with reference to the bottom edges of the other blade segments in the bottom blade portion.

4. The device as defined in claim 2, wherein the plurality of first bias mechanisms includes a plurality of first return spring mechanisms connected to the blade segments, each first return spring mechanism cooperating with a single one of the blade segments and urging the bottom edge of the corresponding blade segment towards the downward working position.

5. The device as defined in claim 4, wherein the bottom blade portion includes at least one support frame member, at least some of the blade segments being in a sliding engagement with the support frame member, the first return spring mechanisms being mounted between the corresponding blade segments and the support frame member.

6. The device as defined in claim 5, wherein the blade segments are in sliding engagement with a front surface of the support frame member.

7. The device as defined in claim 5, wherein the second bias mechanism includes at least one second return spring mechanism mounted between the support frame member and the upper blade portion.

8. The device as defined in claim 7, wherein the pivot axis is located at the rear of the front surface of the scraper blade device, the second return spring mechanism being mounted between the support frame member at a location at the rear rearward of the pivot axis, and a location at a rear of the upper blade portion.

9. The device as defined in claim 5, wherein the at least one support frame member is more than one in number and that the at least one second bias mechanism is more than one in number, each support frame member being independently pivotable around the pivot axis.

10. The device as defined in claim 9, wherein at least some of the support frame members each include a first front plate and a second front plate, both defining an obtuse angle between them.

11. The device as defined in claim 10, wherein the first front plate and the second front plate are rigidly connected together through a plurality of braces located on a rear side of a corresponding one of the support frame members.

12. The device as defined in claim 11, wherein the first front plate includes a plurality of spaced-apart slots extending substantially perpendicular to the lowermost edge of the scraper blade device, each slot guiding a corresponding one of the blade segments that is in sliding engagement with the first front plate.

13. The device as defined in claim 12, wherein each second front plate includes a plurality of apertures through which are partially inserted the upper portion of the corresponding blade segments, the corresponding blade segments each including at least one grease fitting through which grease can be provided to lubricate an interface between the rear side face of the blade segment and the first front plate.

14. The device as defined in claim 9, wherein the device is made of a plurality of identical sections connected side-by-side, each section having a width corresponding to that of one of the support frame members.

15. The device as defined in claim 1, wherein the upper portion and the bottom portion of at least some of the blade segments are pivotally connected to one another.

16. The device as defined in claim 15, wherein the upper portion and the bottom portion are pivotally connected to one another through a flexible member.

17. The device as defined in claim 16, wherein the flexible member is positioned on the rear side face of a corresponding one of the blade segments, the flexible member being made of a polymeric material and being removably connected to the corresponding blade segment.

18. The device as defined in claim 1, wherein the bottom edges of all blade segments are pivotally movable with reference to the surface to be cleaned.

19. The device as defined in claim 1, wherein each blade segment has a width between 3 cm and 100 cm.

* * * * *